US008388090B2

(12) United States Patent
Nakajima et al.

(10) Patent No.: US 8,388,090 B2
(45) Date of Patent: Mar. 5, 2013

(54) PRINTING APPARATUS AND PRINT CONTROLLING METHOD

(75) Inventors: Yoshinori Nakajima, Yokohama (JP); Katsushi Hara, Yokohama (JP); Takuya Hatakeyama, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 417 days.

(21) Appl. No.: 12/543,670

(22) Filed: Aug. 19, 2009

(65) Prior Publication Data

US 2010/0045726 A1 Feb. 25, 2010

(30) Foreign Application Priority Data

Aug. 22, 2008 (JP) ..... 2008-213789

(51) Int. Cl.
*B41J 29/38* (2006.01)

(52) U.S. Cl. ..... 347/16; 347/9; 347/19

(58) Field of Classification Search ..... 347/5, 9, 347/16, 14, 19; 358/1.12
See application file for complete search history.

(56) References Cited

U.S. PATENT DOCUMENTS

| | | | | |
|---|---|---|---|---|
| 6,435,639 | B1 | 8/2002 | Nakajima et al. | |
| 6,655,772 | B2 | 12/2003 | Danzuka et al. | |
| 6,966,629 | B2 | 11/2005 | Nakajima et al. | |
| 7,119,914 | B2 | 10/2006 | Nakajima et al. | |
| 7,144,093 | B2 | 12/2006 | Nakajima et al. | |
| 2005/0122355 | A1 | 6/2005 | Kanda et al. | |
| 2006/0269342 | A1 * | 11/2006 | Yoshida et al. | 400/62 |
| 2008/0049272 | A1 | 2/2008 | Onuma et al. | |
| 2009/0040263 | A1 | 2/2009 | Tomida et al. | |
| 2009/0079777 | A1 | 3/2009 | Nagamura et al. | |

FOREIGN PATENT DOCUMENTS

| | | |
|---|---|---|
| JP | 2008-50083 | 3/2008 |

* cited by examiner

*Primary Examiner* — Lam S Nguyen
(74) *Attorney, Agent, or Firm* — Fitzpatrick, Cella, Harper & Scinto

(57) ABSTRACT

In conveying a print medium before and after a stop-unstable region in a printing apparatus, an image quality is improved while restricting a reduction of a throughput. Specifically a conveying amount is made smaller than a first conveying amount in a usual region. Thereby, the first conveying amount is maximized and the printing in the image region can be complemented by four times of scans after the conveyance of the conveying amount is completed.

21 Claims, 17 Drawing Sheets

PRINTING APPARATUS AND PRINT CONTROLLING METHOD

BACKGROUND OF THE INVENTION

1. Field of the Invention

The present invention relates to a printing apparatus and a print controlling method, and particularly, to a conveying control of a printing medium before and after timing when the print medium leaves from a conveying roller at the upstream side of a printing region in print-medium conveying.

2. Description of the Related Art

Conveyance of a print medium such as a print paper in a printing apparatus such as an ink jet printer is generally carried out by a conveying mechanism formed of a conveying roller and a pinch roller provided at the upstream side of a printing region in a conveying path and by a conveying mechanism formed of a paper discharging roller and a spur provided at the downstream side thereof. In regard to the print medium conveyance by these mechanisms, for example, when performing a so-called margin-less printing, the conveyance of the print medium may be carried out in a state where the conveying mechanism at the upstream side or at the downstream side is not involved in the conveyance. More specifically, at the time of performing the printing until a rear end of the print medium by ejecting ink even on a portion out of the rear end of the print medium, the print medium is conveyed in a state of sandwiching the print medium only by the paper discharging roller and the spur at the downstream side.

It is conventionally known that, while a conveyance state transfers to the conveyance state in which the print medium is sandwiched only by the paper discharging roller and the spur at the downstream side, the print medium may be conveyed by an unexpected amount when the print medium disengages from a state of being held between the conveying roller and the pinch roller at the upstream side. This event is a phenomenon called a so-called kicking-away, and particularly since a conveying amount of the print medium can not be definitely controlled, this phenomenon causes the difficulty of controlling the conveying amount around a point on the conveying path of the print medium at which the print medium disengages from the state of being held between the conveying roller and the pinch roller at the upstream side.

For overcoming this problem, Japanese Patent Laid-Open No. 2008-050083 discloses a conveying control in which a certain range of the conveying path around a point at which the rear end of the print medium passes (engages from) the conveying roller at the upstream side is defined as a range where the rear end of the print medium can not be stably stopped in a desired position. In addition, this conveying control is designed to exclude the conveyance of a conveying amount by which the rear end of the print medium is positioned to stop within this range.

FIG. 1 is a diagram explaining the conveying control described in Japanese Patent Laid-Open No. 2008-050083 and shows a conveying operation around the point at which the print medium passes the conveying roller. In the figure, reference sign N denote a position of a nip formed of a conveying roller 20 and a pinch roller 40 in a conveying direction. A region of A to B, which contains the nip position N and is a range around the nip position N, is a stop-unstable region in which the rear end of the print medium described above can not be stably stopped in a desired position. A paper 500 as the print medium is conveyed in an arrow E direction in the figure in response to rotation of the conveying roller, while the print paper 500 is held between the conveying roller 20 and the pinch roller 40. A printing head 501 is provided with a plurality of nozzles (not shown) as printing elements, which are arranged in the same direction as the conveying direction of the paper.

Black circles in the figure show positions to which the rear end of the paper 500 moves by each paper conveyance carried out for each scanning by the printing head 501. Reference signs F1, Fv, F2 and F3 each show a conveying amount of the paper conveyance for each scanning by the printing head 501. It should be noted that in the following explanation, these signs F1, Fv, F2 and F3 may be also used to denote a conveying operation of each conveying amount.

As shown in FIG. 1, the conveying control is performed in such a manner that the rear end of the paper 500 is positioned and stopped to avoid the stop-unstable region (between A and B). Specifically, a conveying operation of a predetermined conveying amount F1, in which the paper 500 is relatively stably conveyed in a state of being held between a pair of the conveying roller and the pinch roller at the upstream side and between a pair of the paper discharging roller and the spur at the downstream side, is performed several times. Thereafter, before transferring the conveyance from the conveying amount F1 to a conveying amount F2 smaller than the conveying amount F1, the conveyance of a conveying amount Fv is carried out. The conveyance of the conveying amount F2 is provided with a small conveying amount that is previously determined in consideration of a decrease in conveyance accuracy upon performing printing on the vicinity of the rear end of the paper, and the number of the nozzles used in the printing head 501 is reduced in response to the small conveying amount.

A distance from a position after the paper 500 is conveyed by the conveyance F1 to a position A which is an end of the stop-unstable region where the stop position of the end of the paper is unstably determined is detected, and the conveying amount Fv is defined based upon this distance. More specifically, the conveying amount Fv is defined in such a manner that the rear end of the paper 500 reaches the position A when the conveyance F2 is carried out four times after the conveyance Fv. Therefore, by carrying out the conveyance of a conveying amount F3 (=AB+$\alpha$) after the paper is conveyed to a point where the rear end of the paper is positioned at the position A, the rear end of the paper can stop in the stop-stable region at the downstream side from B point through the region A to B.

FIG. 2 is a diagram showing the paper conveyance shown in FIG. 1 by a change in positional relation between the printing head and the paper. In FIG. 2, for simplification of the drawing, positions of the printing head 501 relative to the paper at the time of conveying the paper 500 in the arrow E direction are shown in such a manner that the printing head 501 moves. The relatively moved printing head 501 is denoted by different numerals 502 to 510 in accordance with a position thereof. FIG. 2 shows an example of a so-called four-pass printing where the printing in a given area in accordance with a conveying amount of the paper 500 is completed by four times of scans. For the four-pass printing, a plurality of nozzles in the printing head 501 (502 to 510) are basically divided into four groups for use. In this figure, four divided nozzle groups in the printing head 501 are respectively denoted by signs 501*a*, 501*b*, 501*c*, and 501*d* (the same is applied to the printing heads 502 to 510 in the other positions). Here, an arrangement length of each of the four divided nozzle groups (number of nozzles×nozzle pitch) is set to be equal to the conveying amount F1 described above. That is, an entire arrangement length of the nozzles in the printing head is F1×4.

In a case of performing the conveying control described in Japanese Patent Laid-Open No. 2008-050083, a reduction of a throughput may occur due to how to define the conveying amount Fv. More specifically, in Japanese Patent Laid-Open No. 2008-050083, the conveying amount Fv is defined based upon each conveying amount F2 of four times of conveyances to be carried out after the conveyance by the conveying amount Fv. Specifically the conveying amount Fv is defined by adding a remainder, which is obtained by dividing the distance to the above position A by the conveying amount F2, to the conveying amount F2. Therefore, as an example shown in FIG. 2, the conveying amount Fv may be larger than the conveying amount F1 in a usual region depending on a magnitude of the conveying amount F2. In a case where the conveying amount Fv is thus larger than the conveying amount F1, when the conveying amount F1 is set to the amount found by dividing the nozzle arrangement length of the printing head by the number of passes (four in the above example) without its modification, an area where the printing is not completed is to be produced. More specifically, as shown in FIG. 2, there is to be produced an area g in the paper 500, although the printing in the entire area is originally designed to be completed by the nozzle groups 502*a*, 503*b*, 504*c*, and 505*d*, which can not become complementary by the nozzle group 505*d*. Accordingly, the conveying amount is required to be small in the conveyance of the conveying amount F1 in the usual region, and also the number of the nozzles for use in the nozzle group is restricted in response to the reduction of the conveying amount. As a result, conveyance F1 in the usual region where the number of times of the conveyances is the largest is carried out in an amount smaller than the maximum-possible conveying amount, thus reducing the throughput largely.

SUMMARY OF THE INVENTION

An object of the present invention is to provide a printing apparatus and a print controlling method which can restrict a reduction of a throughput, in conveying a print medium around a stop-unstable region.

In a first aspect of the present invention, there is provided a printing apparatus that repeats a scanning operation performing scanning of a print head, which arranges a plurality of printing elements in a predetermined direction, in a direction intersecting the predetermined direction and a conveying operation conveying a printing medium in the predetermined direction, to complete printing for a predetermined area of the printing medium with a plurality times of scanning, the apparatus comprising:

a first conveying roller which is located at an upstream side of the print head in predetermined direction for conveying the printing medium;

a second conveying roller which is located at an downstream side of the print head in predetermined direction for conveying the printing medium;

a controller for performing a first conveying operation that conveys the printing medium in a first conveying amount (F1) with use of the first and second rollers, a second conveying operation that conveys the printing medium in a second conveying amount (F2), which is smaller than the first conveying amount, with use of the first and second rollers, a third conveying operation that conveys the printing medium in a third conveying amount (F3) when a conveying condition is transferred from a condition that the printing medium is conveyed with use of both the first and second rollers to a condition that the printing medium is conveyed with use of only the first roller, and fourth conveying operation that conveys the printing medium in a variable conveying amount (Fv) when changing a conveying operation from the first conveying operation to the second conveying operation, wherein the controller performs the fourth conveying operation in the conveying amount that is equal to or smaller than the first conveying amount.

In a second aspect of the present invention, there is provide a printing method for repeating a scanning operation performing scanning of a print head in a scan direction and a conveying operation conveying a printing medium in a direction intersecting the scan direction, to complete printing for a predetermined area of the printing medium with a plurality times of scanning, the method comprising:

a step of using a first conveying roller which is located at an upstream side of the print head in predetermined direction for conveying the printing medium and a second conveying roller which is located at an downstream side of the print head in predetermined direction for conveying the printing medium, and of performing a first conveying operation that conveys the printing medium in a first conveying amount (F1) with use of the first and second rollers, a second conveying operation that conveys the printing medium in a second conveying amount (F2), which is smaller than the first conveying amount, with use of the first and second rollers, a third conveying operation that conveys the printing medium in a third conveying amount (F3) when a conveying condition is transferred from a condition that the printing medium is conveyed with use of both the first and second rollers to a condition that the printing medium is conveyed with use of only the first roller, and fourth conveying operation that conveys the printing medium in a variable conveying amount (Fv) when changing a conveying operation from the first conveying operation to the second conveying operation, wherein the step performs the fourth conveying operation in the conveying amount that is equal to or smaller than the first conveying amount.

According to the above structure, the conveying amount of the first conveying operation is maximized and the printing can be completed by plural times of scans after the fourth conveying operation is performed. At the time of performing the second conveying operation after the fourth conveying operation is performed, the printing can be completed with existence of a printing element used for complementing the printing in performing the printing likewise by plural times of the scans while minimizing the number of times of the second conveying operations. Further, the conveying amount of the fourth conveying operation can be made larger than the second conveying amount.

In consequence, for example, the number of the printing elements is used effectively in the printing of the rear end area of the print medium, so as to restrict a reduction of the throughput of the printing operation.

Further features of the present invention will become apparent from the following description of exemplary embodiments (with reference to the attached drawings).

DESCRIPTION OF THE EMBODIMENTS

Hereinafter, embodiments of the present invention will be in detail explained with reference to the drawings.

First Embodiment

Figure 3:
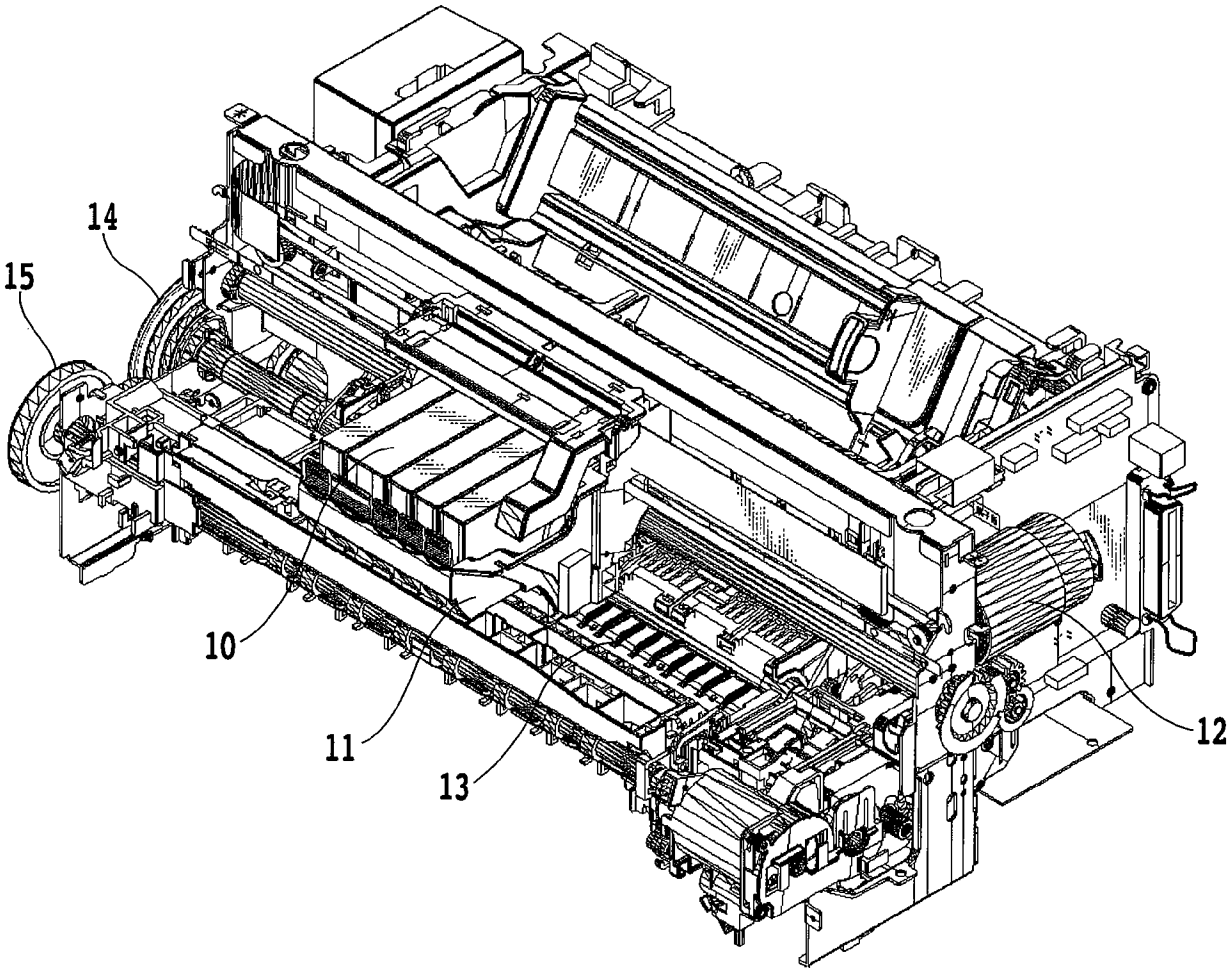
FIG. 3 is a perspective view showing an ink jet printing apparatus according to an embodiment of the present invention.

FIG. 3 is a perspective view showing an ink jet printing apparatus according to an embodiment in the present invention. A printing head (not shown) and ink cartridges 10 are detachably mounted in a carriage 11, and thereby, the printing head scans a print medium such as a paper in a main scan direction and ejects ink on the print medium during the scanning for performing printing. A carriage motor 12 is a drive source for moving the carriage 11. The print paper is conveyed by a given amount in a sub scan direction orthogonal to the main scan direction by a conveying mechanism. An image can be printed on the paper by thus repeating the paper conveyance in the given amount and the scan of the printing head. That is, the printing head in which a plurality of nozzles are lined up scans a plurality of times the print medium with interposing the conveying operation in a printing region between the upstream side and the downstream side, thus completing the printing in a given region in the print medium by a plurality of times of scans.

Figure 4:
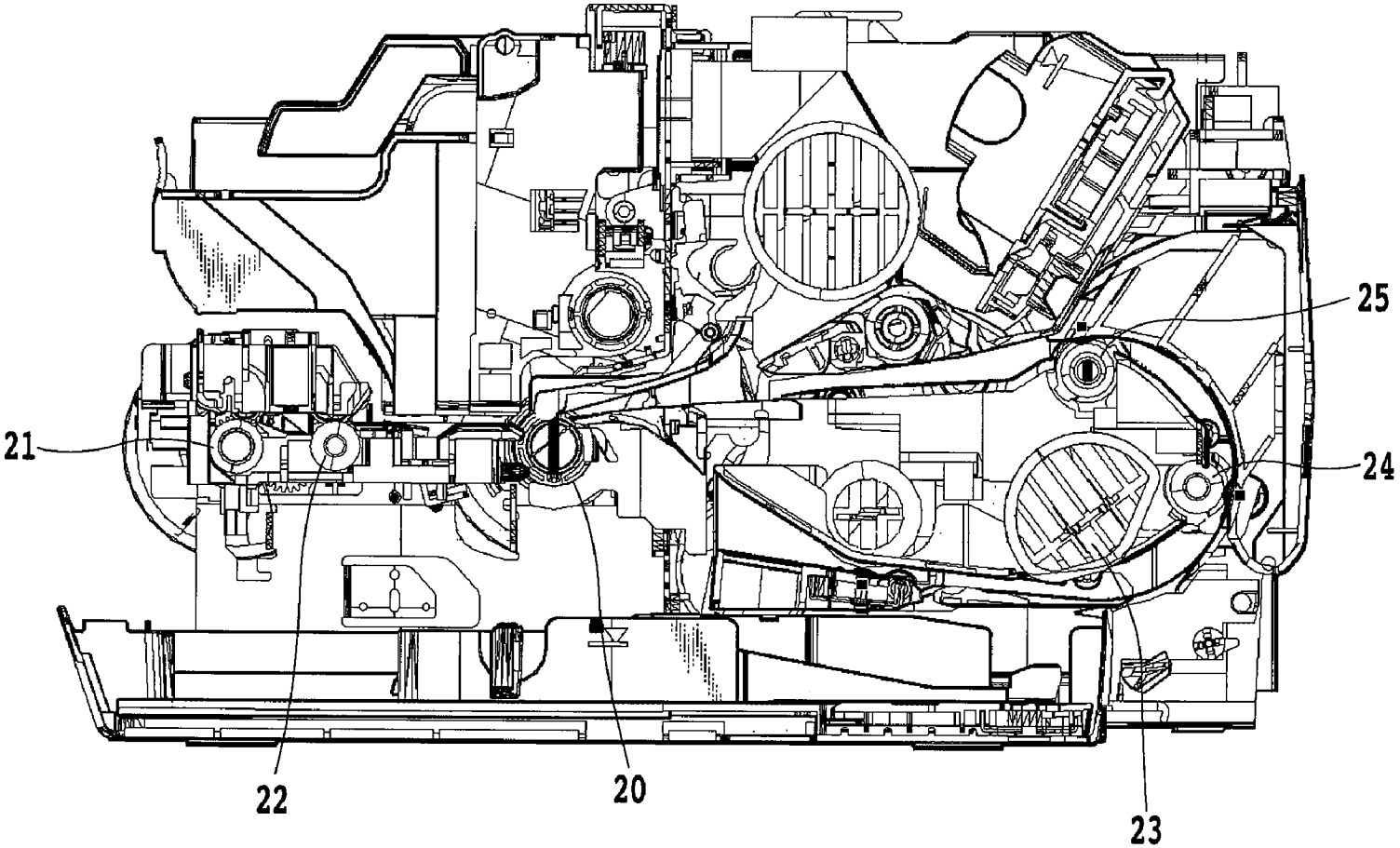
FIG. 4 is a cross section of the printing apparatus shown in FIG. 3 viewed from its side.

FIG. 4 is a cross section of the printing apparatus shown in FIG. 3 viewed from its side. In FIG. 4, reference numeral 20 denotes a conveying roller (constituting a first conveying mechanism), and reference numerals 21 and 22 respectively denote paper discharging rollers (constituting a second conveying mechanism). A pinch roller is configured as a pair to the conveying roller 20 and a spur is configured as a pair to each of the paper discharging rollers 21 and 22, thus holding a paper to be conveyed between each pair. Numeral 23 shows a paper feeding roller which picks up the paper from a paper feeding tray at the lower side of the apparatus. The picked-up paper is conveyed through a first intermediate roller 24 and a second intermediate roller 25 to a nip portion between the conveying roller 20 and the pinch roller. The conveyance route in the midway is formed in a U-letter shape as shown in FIG. 4.

Figure 5:
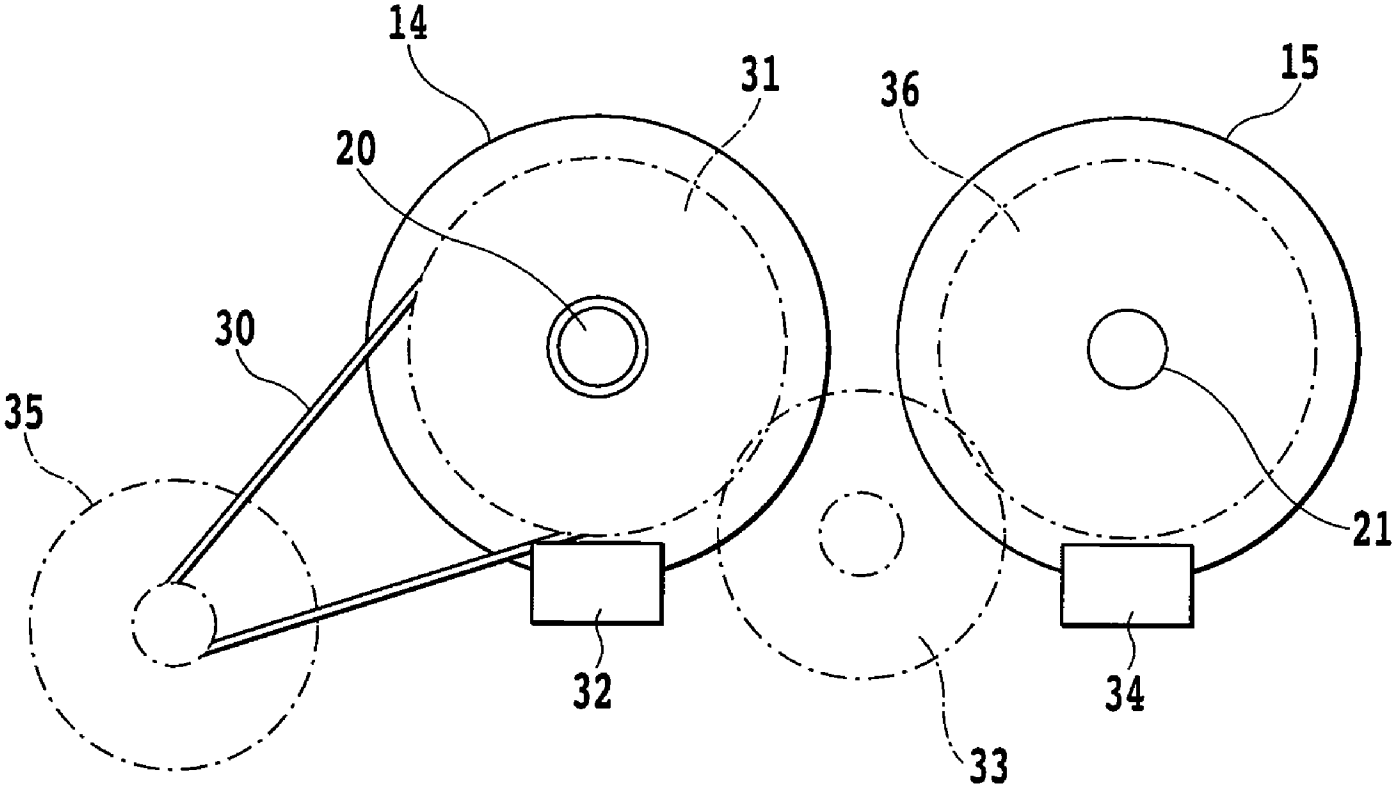
FIG. 5 is a cross section showing a drive mechanism such as a conveying roller shown in FIGS. 3 and 4.

FIG. 5 is a cross section showing a drive mechanism for the conveying roller and the like. As shown in FIG. 5, drive of the conveying roller 20 is performed by transmitting a drive force of a DC motor 35 through a timing belt 30 to a pulley 31 provided in an axis of the conveying roller 20. A code wheel 14 is provided in the axis of the conveying roller 20 for detecting a conveying amount of the paper by the conveying roller 20, and an encoder sensor 32 for reading the conveying amount is attached to an underbody in a position adjacent to the code wheel 14. A drive force of the conveying roller 20 is transmitted through an idler gear 33 to the paper discharging roller 21. A code wheel 15 is provided in an axis of the paper discharging roller 21 for detecting a conveying amount of the paper by the paper discharging roller 21, and an encoder sensor 34 for reading the conveying amount is attached to an underbody in a position adjacent to the code wheel 15.

Figure 6:
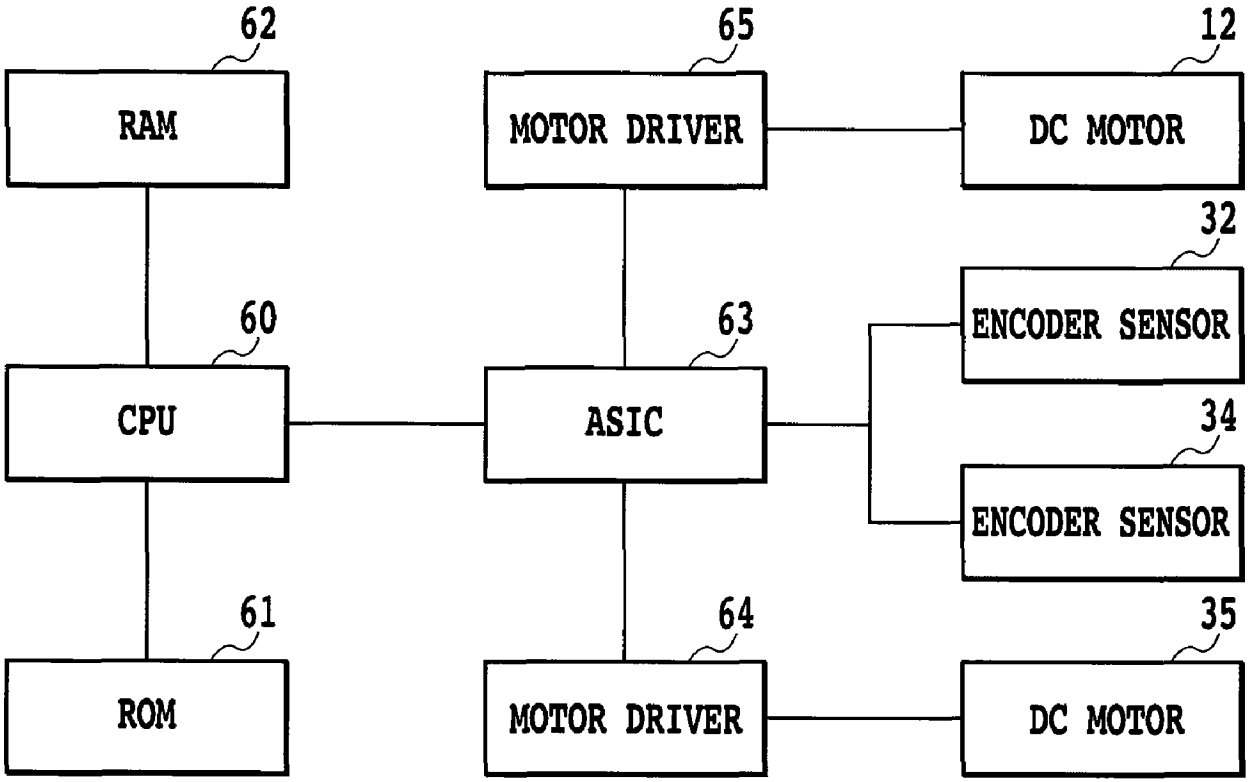
FIG. 6 is a block diagram showing the control construction of the printing apparatus shown in FIG. 3.

FIG. 6 is a block diagram showing the control construction in the printing apparatus of the present embodiment. In FIG. 6, a CPU 60 performs control programs stored in a ROM 61, which includes a conveying control to be described later FIG. 7 or later. A RAM 62 is used as a work area for performing the control of the CPU 60. An ASIC 63 processes information from the encoder sensors 32 and 34 during the controlling by the CPU 60 and controls the DC motors 35 and 12 respectively through motor drivers 64 and 65, thereby performing the conveying operation of the printing medium and the scanning of the printing head.

Figure 1:
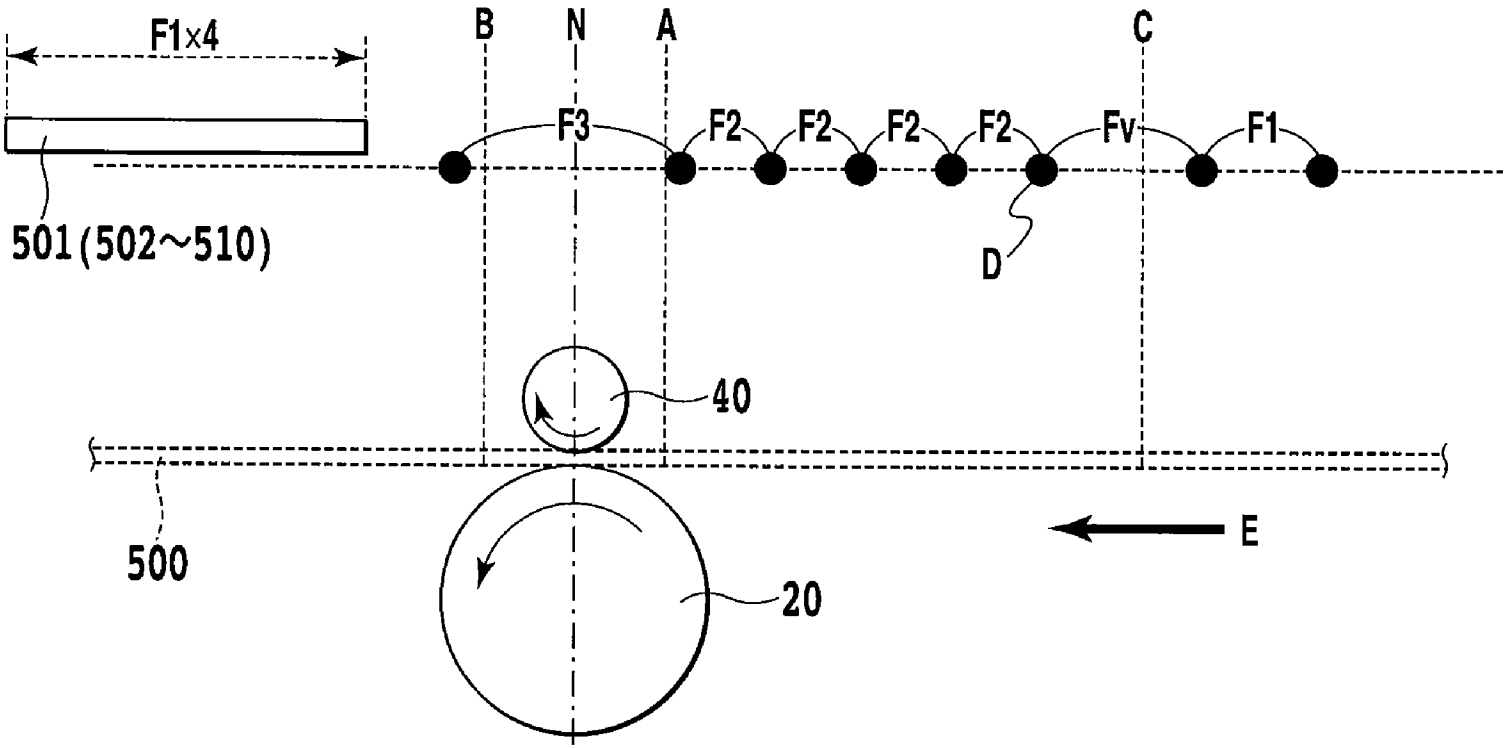
FIG. 1 is a diagram explaining the conventional conveying control.
Figure 2:
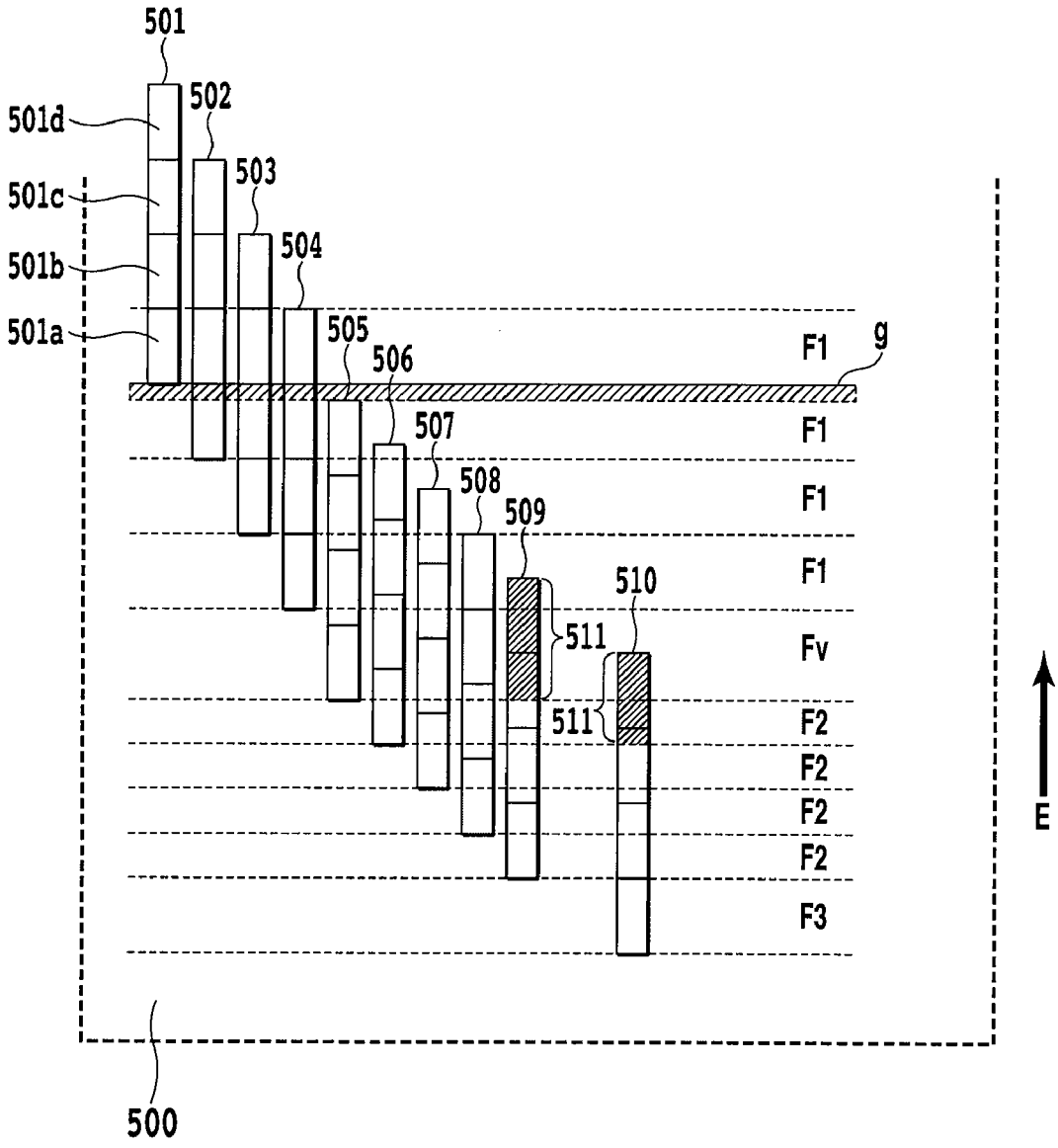
FIG. 2 is a diagram showing the paper conveyance shown in FIG. 1 by a change in positional relation between a printing head and a paper.
Figure 7:
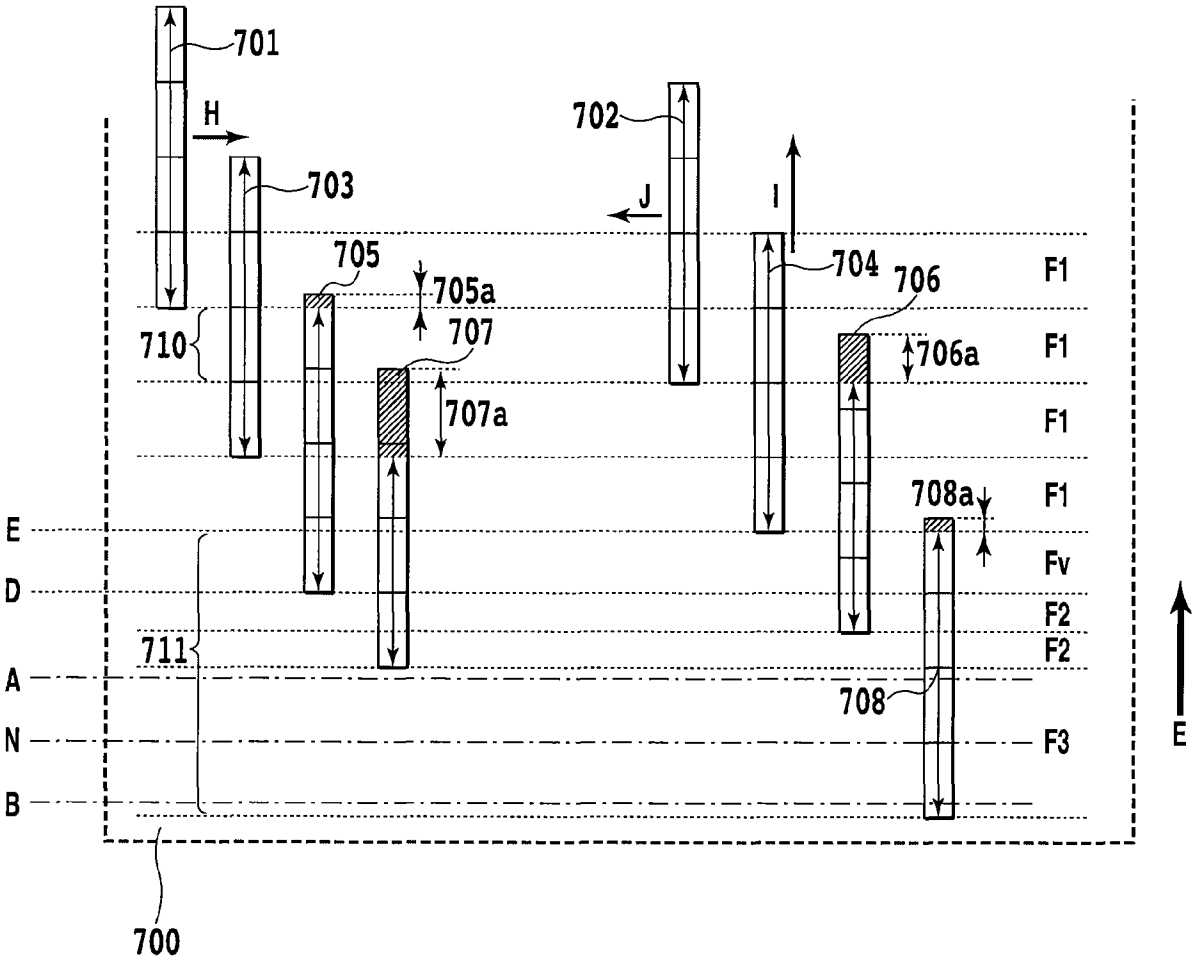
FIG. 7 is a diagram explaining paper conveying control in the printing apparatus according to a first embodiment of the present invention.

FIG. 7 is a diagram explaining the paper conveying control according to a first embodiment of the present invention. In the same way as explained in FIG. 2, reference numerals 701 and 708 each denote a printing head and denote relative positions of the printing head relative to a paper 700, which change in response to the conveyance of the paper. The printing head 701 (-708) is designed to array 640 nozzles with a pitch corresponding to 1200 dpi. An example shown in the figure illustrates a four-pass printing which completes the printing with four times of scanning of the printing head. Data for each of the four times of the scans is generated by thinning data for an area completed by the four times of the scans using predetermined thinning patterns. More specifically, the thinning patterns are four patterns that are complemented in a predetermined area to which printing is completed by the four times of scans. In the figure, a range of the nozzles used for each scan of the printing head in each position is shown in an arrow.

In the print medium conveying control of the present embodiment, the scan is carried out at the printing head position 701 in an arrow H direction in a usual region, and during the scanning, inks are ejected from nozzles in use to the paper 700 to perform printing. Next, the paper is conveyed by a conveying amount F1 (an amount corresponding to 160 nozzles) in an arrow I direction (sub scan). In the printing head position 702 positioned by the above conveyance, the scan is carried out in an arrow J direction in opposite to the above direction to perform printing. The reciprocal scans of the printing head is thus repeated while interposing the paper conveyance therebetween, wherein the conveying operation of the conveying amount F1 (first conveying operation) and the printing operation in response to the conveyance are performed, until the printing head reaches the printing head position 704. Here, the conveying amount F1 corresponds to a value found by dividing the array length of all the use nozzles in the printing head 701 by the number of passes (four in this example).

In the present embodiment, the rear end of paper should stop to be positioned at a position D in order to avoid that the rear end of paper stops in the unstable region of stop accuracy (between A and B). More specifically, conveying operations that follow positioning of the rear end of paper to the position D are determined so that after stopping the rear end of paper at the position D, the conveyance of the conveying amount F2 (corresponding to 80 nozzles) is performed (second conveying operation) two times to move the rear end of paper to the position A and the conveyance of the conveying amount F3 (corresponding to 320 nozzles) is performed (third conveying operation).

When the position of the rear end of paper is detected by a PE sensor (not shown), a position (position E), to which the conveying operation of the conveying amount F1 can convey the print medium under the condition that the conveying operation of the conveying amount F1 is performed as many times as possible without passing over the position D, is calculated. The position E varies depending on a condition such as a start position of printing an image in the conveying direction on the print medium or the like.

In the example shown in FIG. 7, the position E is defined to be a position apart from the position D toward downstream side of the conveying direction by a distance corresponding to 144 nozzles, and from the position E, the paper 700 is conveyed (fourth conveying operation) by the conveying amount Fv (an amount corresponding to 144 nozzles) to move the printing head to the position 705. The conveying amount Fv is defined to be a value smaller than the conveying amount F1 by determining the position E as described above. The scan is carried out in an arrow H direction at the printing head position 705 to perform printing. At this time, nozzles 705*a* not used in the printing head 705 are composed of 16 nozzles (160−144).

Next, the paper 700 is conveyed (second conveying operation) by the conveying amount F2 (corresponding to 80 nozzles) to move the printing head to the position 706. At this time, nozzles 706*a* not used in the printing head 706 are composed of 96 nozzles (16+(160−80)). Further, likewise the paper 700 is conveyed by the conveying amount F2 to move the printing head to the position 707, and printing is performed with nozzles 707*a* not used corresponding to 176 nozzles (96+(160−80)).

Next, the paper 700 is conveyed (third conveying operation) by the conveying amount F3 (corresponding to 320 nozzles) to move the printing head to the position 708. In addition, the scan is carried out in an arrow I direction to perform printing. At this time, nozzles 708*a* not used are composed of 16 nozzles (=176+160−320).

After the paper 700 is conveyed by the conveying amount F3, the paper 700 is again conveyed by the same conveying amount F2 as the above to perform the printing in the vicinity of the rear end in the paper 700.

As explained above, according to the conveying amount control of the present embodiment, in the printing accompanied by the conveying F1 in the usual region, the conveying amount F1 can be maximized, that is, can be made to a value found by dividing the array length of all the use nozzles by the number of passes. In consequence, a reduction of the throughput in the usual region where the number of the conveyance times is large can be restricted.

The conveying amount Fv is used to control the conveying operation in such a manner that the paper rear end does not stop in the unstable region of stop accuracy (between A and B), and in the present embodiment, the conveying amount of Fv is adjusted so that the paper rear end stops in a position D shown in FIG. 7, after the print medium is conveyed as many times as possible by the conveying operation of the conveying amount F1. In the present embodiment, the conveying amount Fv can be defined as a value smaller than the conveying amount F1. Thereby, the nozzles not used in the printing head are not necessarily set in a printing operation with the conveying operation of the conveying amount F1 and therefore the throughput can be improved. It should be noted that though the present embodiment relates to an example that uses all the nozzles in the printing head, an embodiment that uses a part of nozzles in the printing head may be included in the present invention.

In addition, the conveying amount and the number of conveyance times of the conveying amount F2 and the conveying amount of the conveying amount F3 are not limited to the above example. The conveying amount and the number of conveyance times of the conveying amount F2 and the conveying amount of the conveying amount F3 may determined as values satisfy following relations.

In a case $n \leqq$ number of passes−2, $$F3+F2\times n+Fv+F1\times(\text{number of passes}-(n+2)) \leqq \text{nozzle arrangement length} \qquad \text{Expression (1A)}$$

In a case $n \geqq$ number of passes−1, $$F3+F2\times(\text{number of passes}-1) \leqq \text{nozzle arrangement length} \qquad \text{Expression (1B)}$$

These conditions are conditions for complementally complete an image area corresponding to the conveying amount Fv after the conveying F3 by the multi-pass printing and mean that the total conveying amount of the conveyance F3 and the conveyances F2 and Fv (and F1 depending on the value of n) before the conveyance F3 is smaller than an arrangement length of all the nozzles of nozzle array. In other wards, the conveying amount and the number of conveyance of the conveying F2 and the conveying amount of the conveying F3 are determined so that the total conveying amount of conveying operations corresponding to successive passes before the third conveying operation (four times of the conveying operations in the present embodiment) is made smaller than the arrangement length. It should be noted that the number of passes varies depending on various printing conditions such as printing modes and accordingly the conveying amount and the number of conveyance of the conveying F2 and the conveying amount of the conveying F3 are determined for each number of passes.

The example shown in FIG. 7 corresponds to Expression (1A) where the number of passes is 4. The numerical values of the example used in the above explanation are as follows. F1=160, F2=80, F3=320, and n=2, and when substituting these values into Expression (1A), "320+80×2+Fv+160×(4−(2+2))≦640" is established so that a relation Fv≦160 is derived. The above described conveying control repeats the conveying operation of the conveying amount F1 as many times as possible to convey the print medium to the position E so that the relation Fv≦F1 (160) is derived. Therefore, it is understood that the conveying amount and the number of conveyance of the conveying F2 and the conveying amount of the conveying F3 are previously determined so that printing of each print area can be complementally completed by the multi-pass printing under the conveying control after the position D regardless of the value of Fv.

Second Embodiment

The conveying control according to a second embodiment of the present invention differs from the first embodiment in that a part of nozzles at the paper rear end side is made to be not used in scans after the conveyance of the conveying amount Fv, in response to a pattern of the mask for each scan used in a multi-pass printing. More specifically, as explained in the first embodiment, when the conveying amount changes F1, Fv and F2 at the time of printing on an area in the vicinity of the rear end of the print medium, a width of an area (hereinafter, also referred to as band) to which printing is completed by plural times of pass (scan) changes in response to the changes of the conveying amount. From this respect, in the masks used in the plural passes, the mutual patterns are required to be complemented for each width of the band. Accordingly, the respective masks of the sizes in accordance with widths of bands are required. In a case where the masks are thus required for the respective band widths and further, particularly the conveying amount Fv changes in accordance with a print mode or the like, it is required to prepare the mask in accordance with a band width differing depending on the conveying amount. As a result, a memory capacity for storing the mask increases. The present embodiment restricts an increase of the kinds of masks for completing printing with the plural passes even if the conveying amount changes, by means of not using a part of the nozzles.

In the present embodiment, the masks for completing the printing of the band by four times of passes has a so-called gradation pattern.

Figure 8:
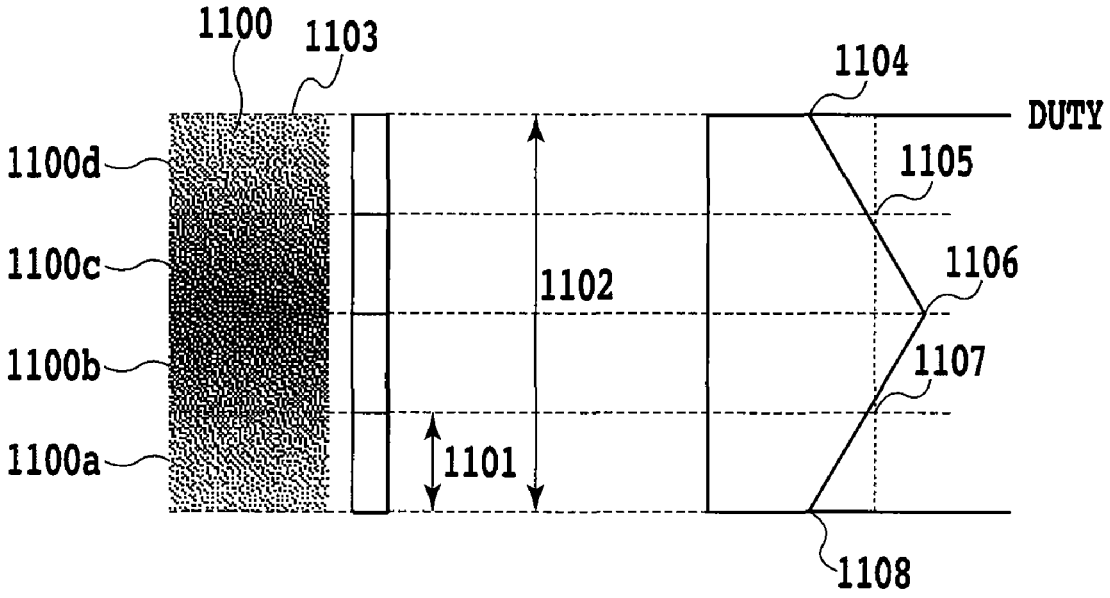
FIG. 8 is a diagram explaining a gradation pattern of a mask according to a second embodiment of the present invention.

FIG. 8 is a diagram explaining the gradation pattern of the mask. Conventionally the gradation pattern as follows is used. That is, the density (hereinafter, referred to as print permitting rate) of print permitting pixels (pixels outputting print data as it is) in the mask pixels is, as shown in FIG. 8, high in a portion corresponding to a nozzle in the center and low in a portion corresponding to a nozzle in the end portion. By using this type of mask, it is possible to realize a reduction of a connection stripe due to variations of the conveyance accuracy of the print medium or a reduction of image quality deterioration due to landing variations of inks from the end nozzle.

A mask 1100 used in a usual region other than the aforementioned rear end region has a lateral size of 512 pixels and a longitudinal size of 640 pixels corresponding to a nozzle length (here, 640 nozzles). This mask is divided into four mask areas of mask areas 1100*a*, 1100*b*, 1100*c*, and 1100*d* corresponding to a width of the band as a unit area, for which printing is completed, when the mask is used in a four-pass printing. Each mask area has a longitudinal size of 160 pixels. A distribution of the print permitting rate, as shown at the right side in FIG. 8, has 12% at a nozzle position 1104 in a mask pixel area 1103 corresponding to an end nozzle. At the boundaries between the respective mask areas, the distribution has 25% at a nozzle position 1105, 38% at a nozzle position 1106, and 25% at a nozzle position 1107. It should be noted that the mask pixel is not exactly defined at the boundary, but these values can be defined as the print permitting rate in one or both of the mask pixel areas adjacent to the boundaries. The same can be applied to the following explanation. Further, the distribution of the print permitting rate has likewise 12% at a nozzle position 1108 in a mask pixel area corresponding to the other end nozzle. The print permitting rates of the mask areas other than the above-mentioned positions are designed to be smoothly connected. The mask areas 1100*a*, 1100*b*, 1100*c*, and 1100*d* are complemented with each other. The mask is designed so that a sum of print permitting rates corresponding to nozzles used for printing of the same pixel areas in these mask areas becomes 100%.

Figure 9:
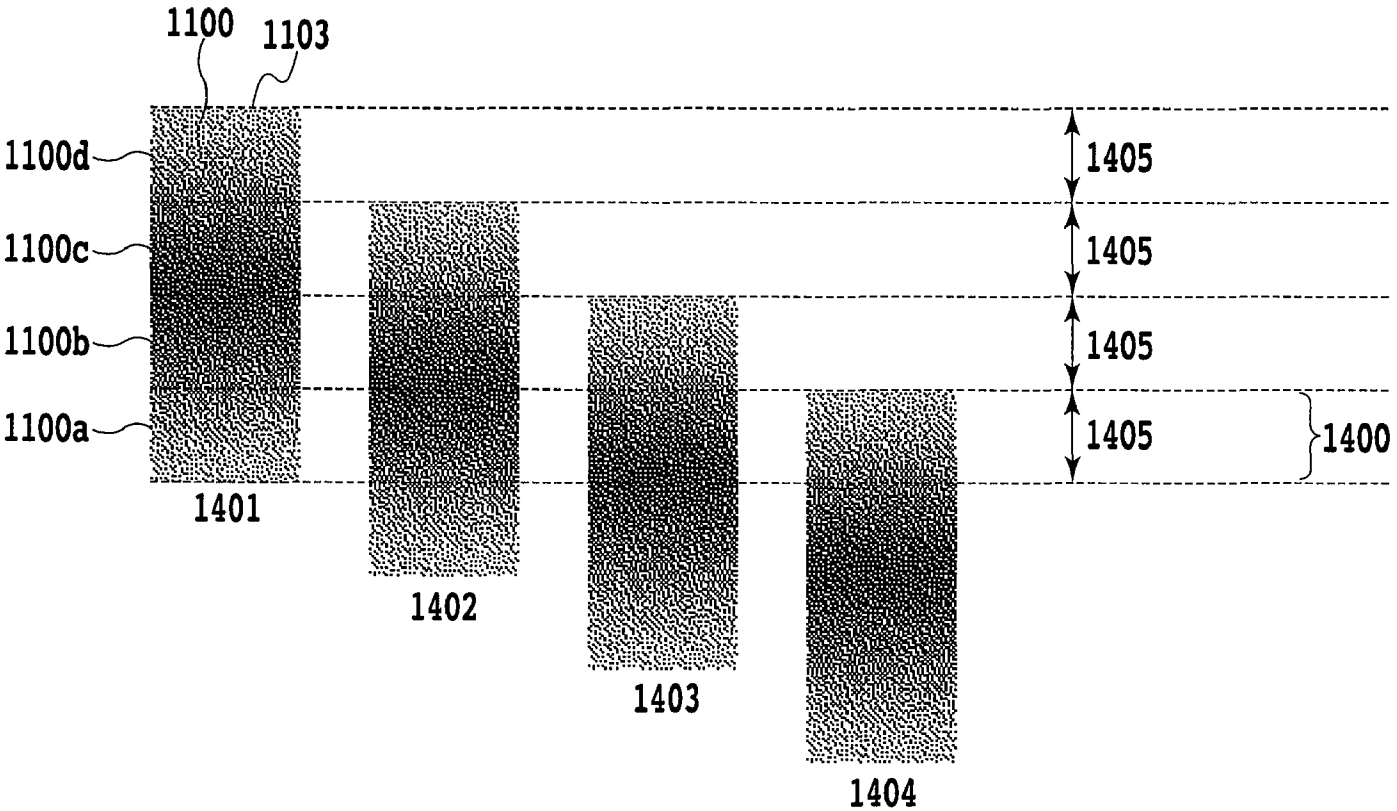
FIG. 9 is a diagram explaining an application of a gradation mask in response to a conveyance and a printing operation in a usual region.

FIG. 9 is a diagram explaining an application of the mask in response to the conveyance and the printing operation in a usual region. In the figure, reference numerals 1401 to 1404 each denotes a position of a mask area in the mask corresponding to a printing head (relative) position (to the print medium) for each scan. Reference numerals 1405 each denotes the band width (160 pixels) in a case of the four-pass printing using all of 640 nozzles as in the usual case, and this width is the same as that of each mask area formed by dividing the mask 1100 into four areas.

Here, as for the band 1400, in the first pass, the printing is performed based upon print data as the result of the AND calculation of the mask area 1100*a* and the print data. That is, the print data of pixels corresponding to print permitting pixels in the mask area are outputted as they are, and the printing is performed based upon the outputted print data. Likewise in each of the second pass, the third pass, and the fourth pass, the printing is performed based upon print data as the result of the AND calculation of each of the mask area 1100*b*, the mask area 1100*c*, and the mask area 1100*d* and the print data. In a case of a so-called solid image made of duty 100% of the image data, the four data of the above AND calculation result overlap to print the solid data of 100% duty.

Figure 10:
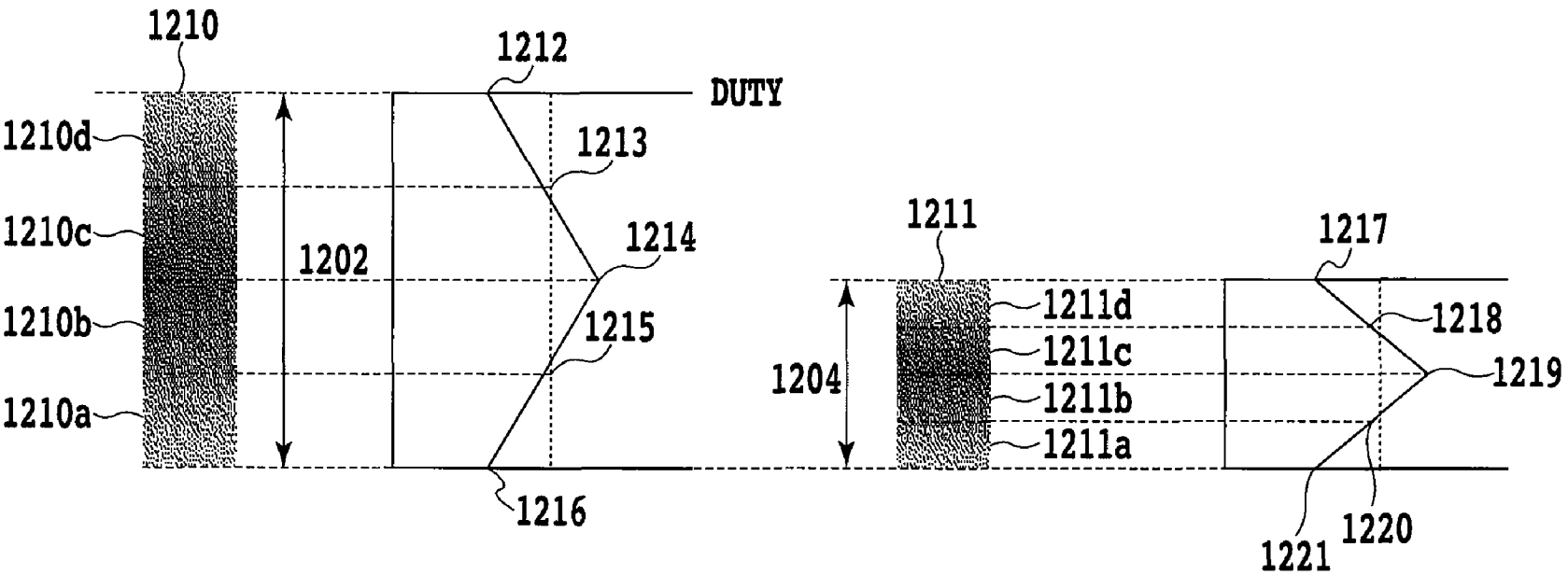
FIG. 10 is a diagram explaining a case of applying the gradation mask to printing in the rear end region.
Figure 11:
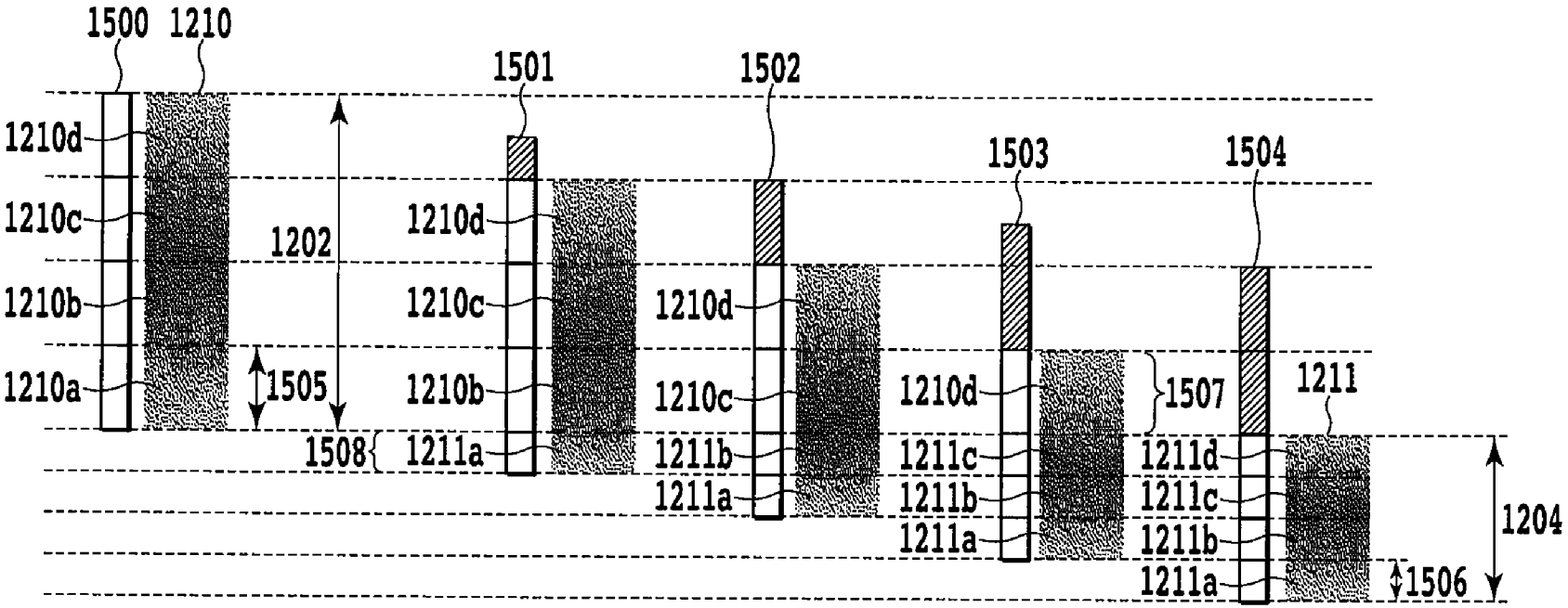
FIG. 11 is la diagram explaining a case of likewise applying the gradation mask to the printing in the rear end region.

FIGS. 10 and 11 are diagrams each explaining a case where the gradation mask explained above is applied to the printing of the rear end region.

In the printing of the rear end region, as explained in the first embodiment, the conveying amount differs for each scan. In this case, masks having plural kinds of sizes are prepared for corresponding to band widths of respective conveying amounts and a smooth mask pattern is produced by cutting and pasting the masks. FIG. 10 shows two kinds of masks used in the printing of the rear end region. The masks are prepared as two masks of a mask 1210 corresponding to a nozzle array 1202 of the number of nozzles 640 and a mask 1211 corresponding to a nozzle array 1204 of the number of nozzles 320. The print permitting rates of the mask 1210 in the nozzle array direction have 12% at a nozzle position 1212, 25% at a nozzle position 1213, 38% at a nozzle position 1214, 25% at a nozzle position 1215, and 12% at a nozzle position 1216. The print permitting rates positions between these nozzle positions are linearly interpolated values. Likewise the print permitting rates of the mask 1211 in the nozzle array direction are 12% at a nozzle position 1217, 25% at a nozzle position 1218, 38% at a nozzle position 1219, 25% at a nozzle position 1220, and 12% at a nozzle position 1221. The print permitting rates between these nozzle positions are likewise linearly interpolated values. In addition, in the same way as the above-mentioned, the masks 1210 and 1211 are divided into four regions (a to d) and patterns (a to d) of the respective mask areas are complemented with each other. That is, a sum of permitting rates for nozzles (for example, 1212, 1213, 1214, and 1215) used for printing of the same pixel area in the four-pass becomes 100%.

FIG. 11 shows relative positions of the nozzle arrays to the paper for the respective scans as nozzle arrays (printing heads) 1500, 1501, 1502, 1503, and 1504 in that order from the first pass. In the figure, a band width 1505 corresponds to an arrangement length of 160 nozzles and a band width 1506 corresponds to an arrangement length of 80 nozzles. In an example shown in this figure, the conveying amount upon transfer to the second pass (nozzle array 1501) changes from the present amount corresponding to 160 nozzles to an amount corresponding to 80 nozzles. That is, FIG. 11, for simplification of explanation of a mask application, shows a state where the conveyance of the conveying amount F1 transfers to the conveyance of the conveying amount F2 not via the conveyance Fv.

Based upon the above conveying control, in the first pass, the printing is performed by ejecting ink from the nozzle array 1500 according to the print data of the AND calculation result of the mask areas 1210*a* to 1210*d* in the mask 1210 and the print data. The second pass, after carrying out the paper conveying corresponding to 80 nozzles, sets 80 nozzles of the nozzle array 1501 shown in a hatched line as non-used nozzles. Then, printing is performed by ejecting ink from the nozzle array 1501 in which the non-used nozzles are set, according to the print data of the AND calculation result of the mask areas 1210*b* to 1210*d* in the mask 1210 and the mask area 1211*a* in the mask 1211, and the print data. Likewise, the third pass, after carrying out the paper conveying corresponding to 80 nozzles, sets 160 nozzles of the nozzle array 1502 shown in a hatched line as non-used nozzles. Then, printing is performed by the scanning of the nozzle array 1502 based on the print data of the AND calculation result of the mask areas 1210*c* to 1210*d* in the mask 1210 and the mask areas 1211*a* and 1211*b* in the mask 1211, and the print data. The fourth pass, after carrying out the paper conveying corresponding to 80 nozzles, sets 240 nozzles of the nozzle array 1503 shown in a hatched line as non-used nozzles. Then, printing is performed by the scanning of the nozzle array 1503 based on the print data of the AND calculation result of the mask area 1210*d* in the mask 1210 and the mask areas 1211*a* to 1211*c* in the mask 1211, and the print data. Further, the fifth pass, after carrying out the paper conveying corresponding to 320 nozzles, sets 240 nozzles of the nozzle array 1504 shown in a hatched line as non-used nozzles, and printing is performed according to the AND calculation result of the mask areas 1211*a* to 1211*d* and the print data. As described above, in a case of completing the printing of the band by the four passes, in the above example, an image 1507 of which a band width corresponds to the arrangement length of 160 nozzles uses the mask areas 1201*a* to 1201*d* in the mask 1210. An image 1508 of which a band width corresponds to the arrangement length of 80 nozzles uses the mask areas 1211*a* to 1211*d* in the mask 1211. Each image is complemented by four times of scans, making it possible to print the image.

By applying the mask as described above, the mask of the print permitting rates continuous in the nozzle array direction can be applied in any pass, and as a result, it is possible to reduce the connection stripes due to variations of the conveyance accuracy and prevent image quality deterioration due to the landing position variations of ink form the end nozzle.

However, in a case of carrying out the above described multi-pass printing method, it is required to prepare masks corresponding to the respective conveying amounts (in examples shown in FIGS. 10 and 11, an amount corresponding to 160 nozzles and an amount corresponding to 80 nozzles). For example, as explained in regard to the first embodiment in FIG. 7, in a case where the conveying amount Fv is set with changing depending on conditions of print start position and the like, the mask similar to the mask 1211 shown in FIG. 10 is required for every conveying amount Fv. Therefore, a capacity for storing mask in a memory (ROM 61 or the like) is to increase.

For preventing an increase of the mask capacity, If a mask of which the band width corresponds to the arrangement length of 80 nozzles is produced by cutting and pasting masks in complementary portions from the mask shown in FIG. 10, the print permitting rates in the nozzle array direction can not be smoothly connected at the boundary of the cut and pasted masks. As a difference between the original mask and the cut band width is the larger, the print permitting rate difference becomes the larger. As a result, the stripe due to the conveyance error is generated at the boundary with the cut mask (connecting portion of the band).

Therefore, the present embodiment, for preventing an increase of the mask capacity and performing the printing with higher image quality, is configured to perform the printing of the band width restricted as much as possible even if the conveying amount varies. The present embodiment is thus explained from a viewpoint of preventing the increase of the mask capacity, but the band width may be particularly not limited as represented in FIG. 7 in the first embodiment.

Figure 12:
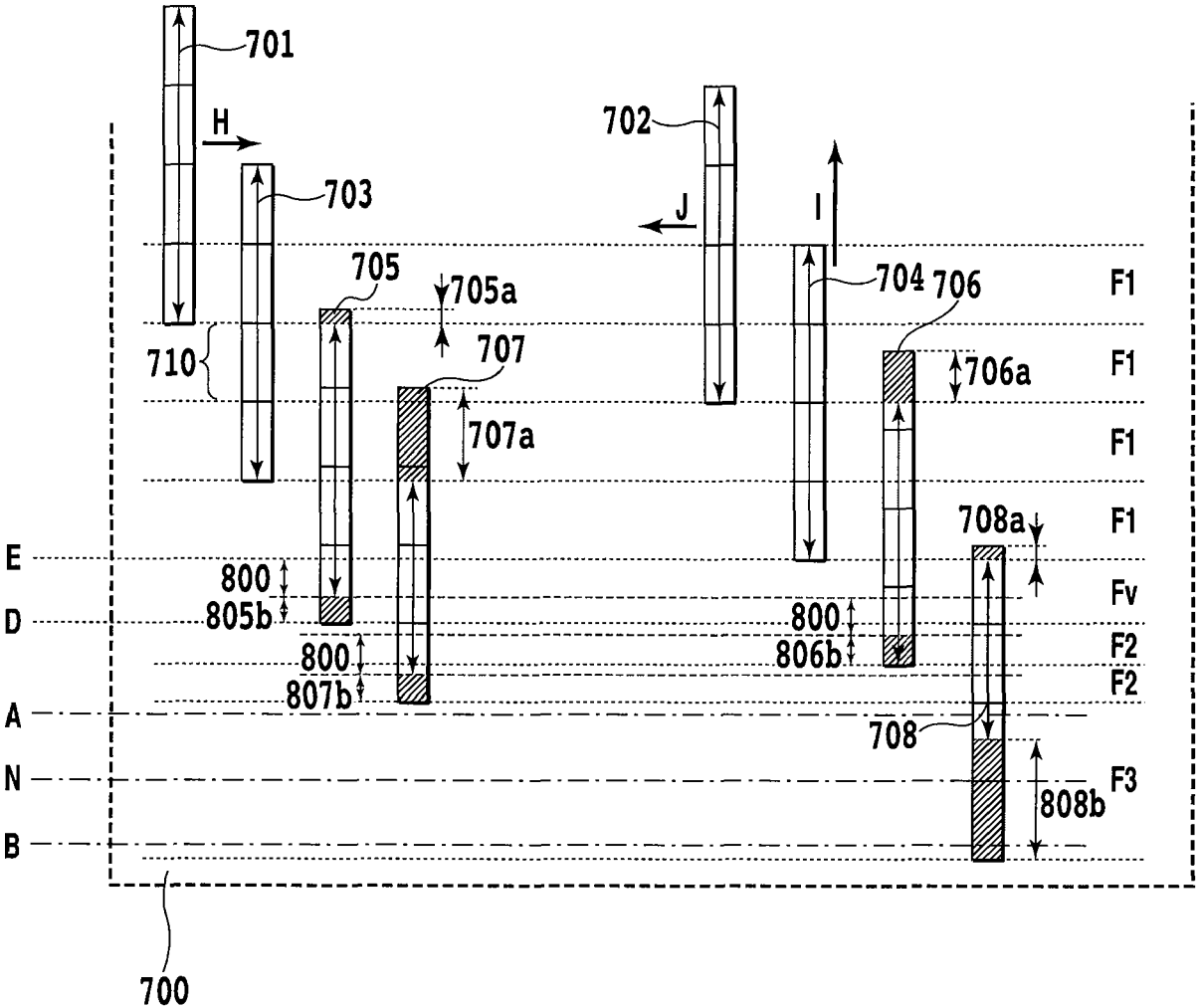
FIG. 12 is a diagram explaining a printing operation according to the second embodiment of the present invention.

FIG. 12 is a diagram explaining a printing operation according to a second embodiment of the present invention. Elements in the second embodiment identical to those in FIG. 7 are referred to as identical references, and the explanations of those elements are omitted. In addition, explanation will be made for a case that the conveying amount Fv corresponds to 144 nozzles.

In the present embodiment, in regard to nozzle arrays in a nozzle array (printing head) position 705 and in a nozzle array position (scan) after the nozzle array position 705 by the conveyance, non-used nozzles are set at the upstream side of each nozzle array. Specifically 64 nozzles found by "144 (Fv)−80(F2)" are set as the respective non-used nozzle arrays 805*b*, 806*b*, and 807*b*. Further, at a nozzle array position 708 after the conveyance of the conveying amount F3 is carried out, 240 nozzles found by "320(F3)−80(F2)" are set as a non-used nozzle array 808*b*. Besides setting the above non-used nozzles, as described before in FIG. 7, non-used nozzles are set at the downstream side of each nozzle array, and as a result, ranges of use nozzles in each of the nozzle positions 701 to 708 are shown by arrows in the nozzle array.

The mask applied to the nozzle array 1500 shown in FIG. 11 is used in the scans of the nozzle array positions 701 and 704 different from the above setting of the use nozzle in the nozzle array. In addition, in the nozzle array position 705, the mask applied to the nozzle array 1501 is used and in the nozzle array position 706, the mask applied to the nozzle array 1502 is used. Further, in the nozzle array position 707, the mask applied to the nozzle array 1503 is used and in the nozzle array position 708, the mask applied to the nozzle array 1504 is used.

The setting of the non-used nozzle is varied depending upon the variable conveying amount Fv. That is, when a relation of the following Expression (2) in regard to the amount F2 is established, nozzles having the number of nozzles shown in Expression (3) can be set as non-used nozzles in the nozzle at the upstream side of the paper conveyance.

$$Fv > F2 \qquad \text{Expression (2)}$$

$$\text{Number of non-used nozzles} = Fv - F2 \qquad \text{Expression (3)}$$

Figure 13:
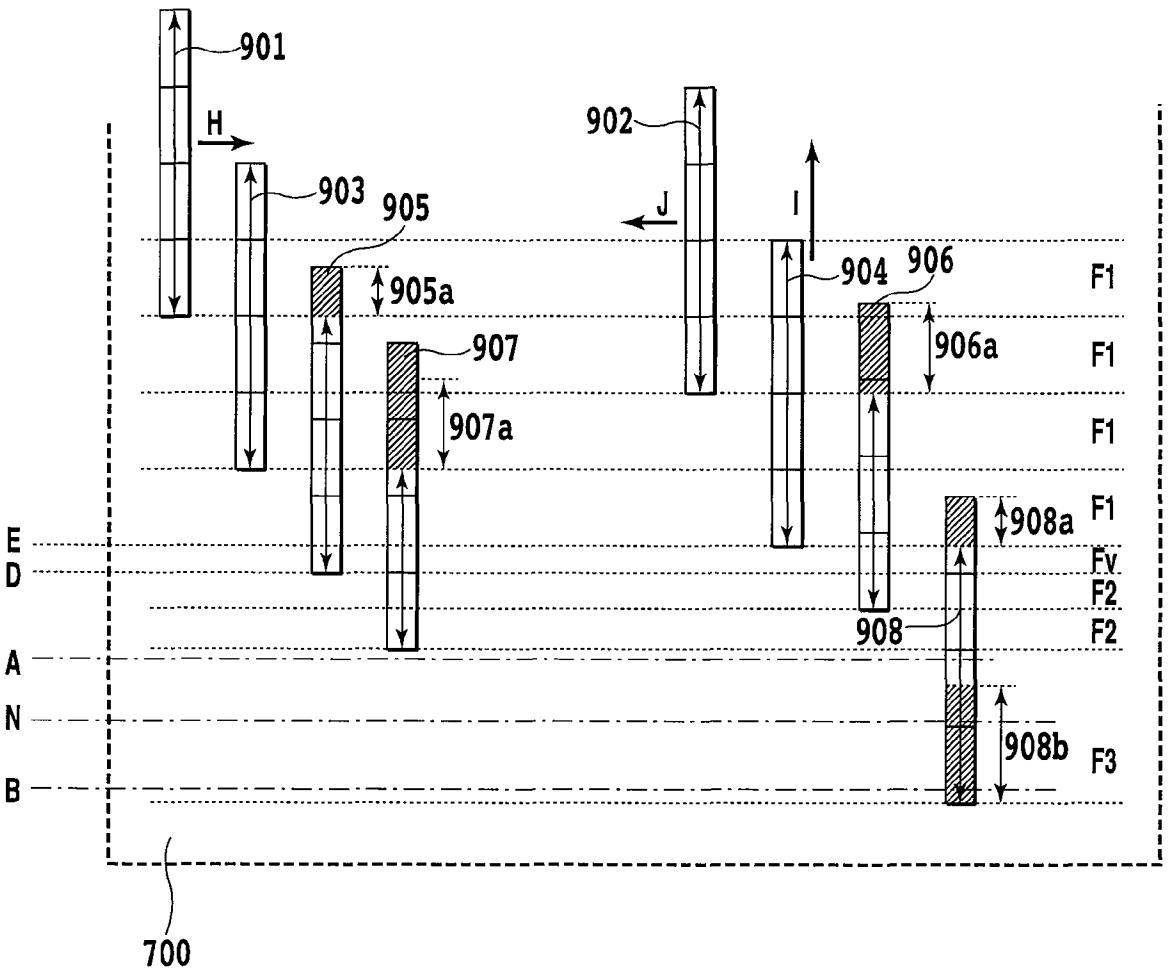
FIG. 13 is a diagram explaining a printing operation regarding the second embodiment of the present invention.

FIG. 13 is a diagram explaining a printing operation in a case that the conveying amount Fv is smaller than the conveying amount F2. As already described, the conveying amount Fv is a variable value varying depending upon the conditions of a print start position and the like and thus in a case that the conveying amount Fv is smaller than the conveying amount F2, following conveying control is implemented. The following explanation will be made for a case that the conveying amount Fv corresponds to 64 nozzles.

Nozzle arrays 901 to 908 show the respective relative positions to the print medium changing in response to the conveyance of the print medium in the same way as the example shown in FIG. 12, and each nozzle array has 640 nozzles as the number of nozzles. Use nozzles at each nozzle array position are shown in each nozzle array by an arrow. That is, non-used nozzles 905*a*, 906*a*, 907*a*, or 908*a* are set at each nozzle array position. In regard to the number of non-used nozzles in each nozzle array, the non-used nozzle 905*a* has 96 nozzles found by 160(F1)−64(Fv), the non-used nozzle 906*a* has 176 nozzles found by 96(905*a*)+160(F1)−80(F2). In addition, the non-used nozzle 907*a* has 256 nozzles found by 176(906*a*)+160(F1)−80(F2) and the non-used nozzle 908*a* has 96 nozzles found by 256(907*a*)+160(F1)−320(F3). Further, the non-used nozzle 908*b* is set in the same way as the example of FIG. 12. The non-used nozzle 908*b* has 240 nozzles found by 320(F3)−80(F2).

In a case of performing the above printing operation, which is different from the example shown in FIG. 12, a band width corresponding to the conveying amount Fv (an amount corresponding to 64 nozzles) exists other than the band widths corresponding to the conveying amount F1 (an amount corresponding to 160 nozzles) and the conveying amount F2 (an amount corresponding to 80 nozzles). The conveying amount Fv may vary for each printing operation.

Figure 14:
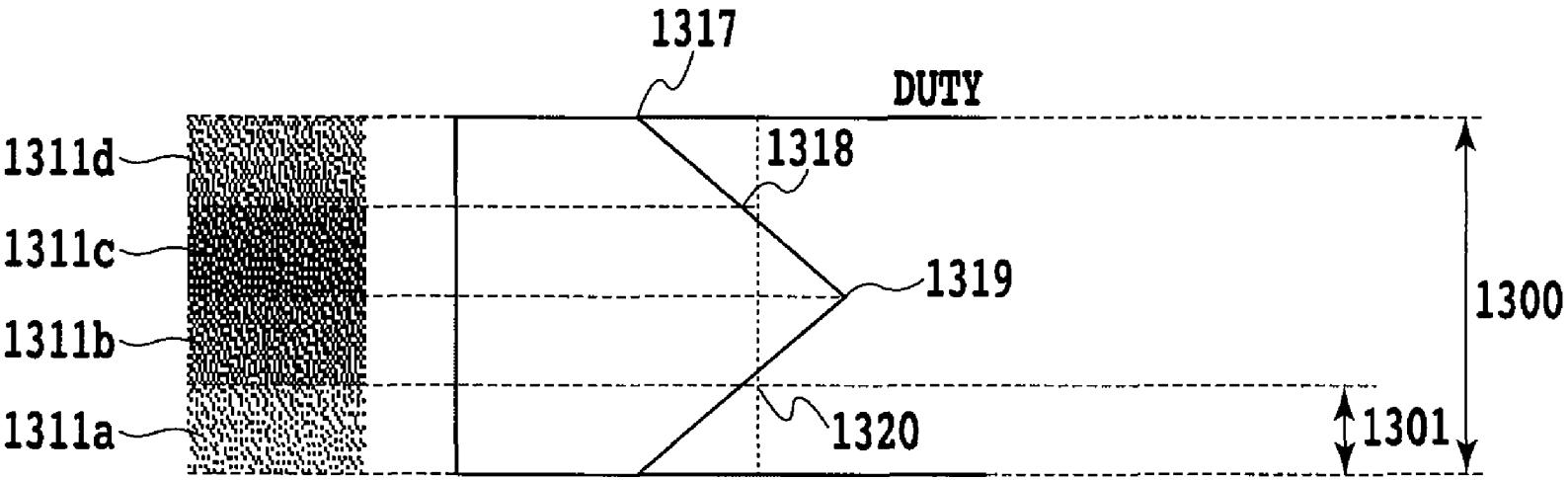
FIG. 14 is a diagram showing a third mask required in a case where the printing operation shown in FIG. 13 is performed.

Accordingly, third masks corresponding to number of the variable conveying amounts Fv is required as so to match values that the band width Fv may take. As one example, a band width 1301 in the third mask (FIG. 14) for the case that the conveying amount Fv corresponds to 64 nozzles has an amount corresponding to 64 nozzles which is the same as the band width Fv, and a band width 1300 has an amount corresponding to 256 nozzles found by Fv×four passes. Mask areas 1311*a* to 1311*d* have a complementary relation with each other, wherein nozzle positions 1317, 1318, 1319, and 1320 respectively have print permitting rates of 12%, 25%, 38%, and 25%.

Figures 15A, 15B, 15C, 15D:
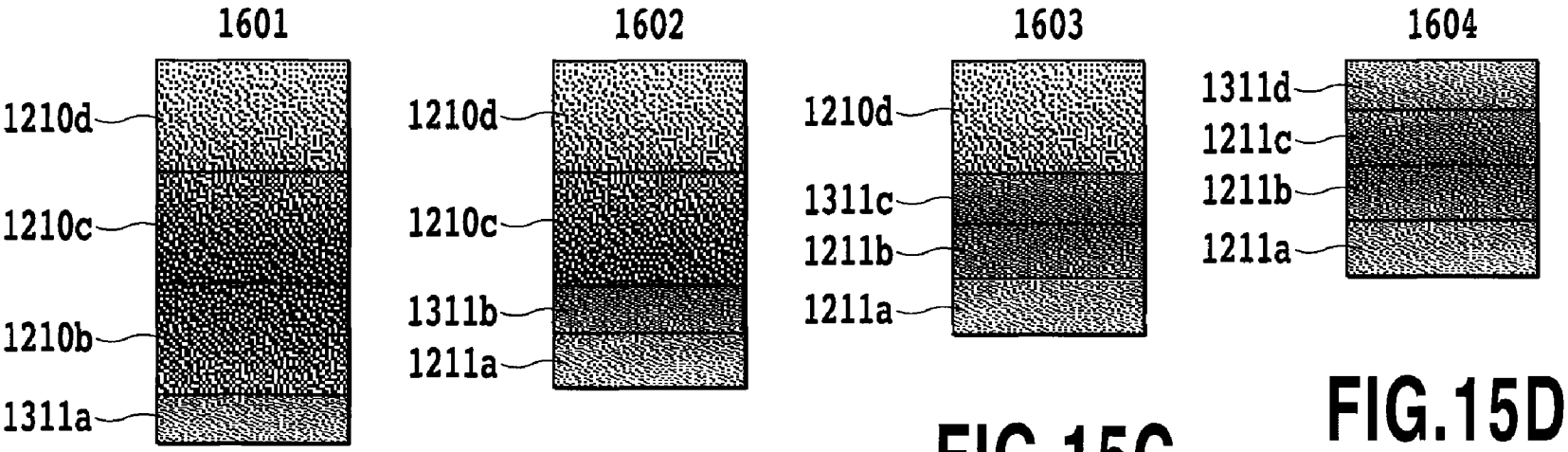
FIGS. 15A to 15D are diagrams each showing a mask made associated with use nozzles in each pass in a case where the printing operation shown in FIG. 13 is performed.

FIGS. 15A to 15D are diagrams each showing a mask associated with use nozzles in each pass. In FIG. 13, in scans at the nozzle array positions 901 to 904, the mask 1210 shown in FIG. 10 is applied. In the scan at the nozzle array position 905, a mask 1601 shown in FIG. 15A is assigned. In the scan at the nozzle array position 906, a mask 1602 shown in FIG. 15B is assigned. In the scan at the nozzle array position 907, a mask 1603 shown in FIG. 15C is assigned. Further, in the scan at the nozzle array position 908, a mask 1604 shown in FIG. 15D is assigned. The mask areas 1210*a* to 1210*d*, and 1211*a* to 1211*d* shown in these figures are mask pattern data of the respective areas in the masks 1210 and 1211 shown in FIG. 10.

By performing the mask application control as described above, the print permitting rates of the masks used in each scan can be smoothly controlled, therefore reducing the connection stripes due to variations of conveyance accuracy and preventing image quality deterioration due to the landing position variations of ink from the end nozzle. However, masks should be prepared for all the conveying amounts Fv to be employed, and therefore the ROM capacity for storing the masks is increased.

As already explained, for preventing an increase of the mask capacity, the masks in a complementary portion in the mask in FIG. 10 may be cut and pasted from the mask in FIG. 10, making it possible to produce a mask. In the present embodiment, there is explained the configuration where plural kinds of masks are provided, each being matched to the band width. In a case of further cutting down on the ROM capacity, as shown in FIG. 16 as follows, by performing control in such a manner as to increase Fv, image quality deterioration can be restricted even in the control by cutting and pasting the masks.

Therefore, the present embodiment makes following changes from the aforementioned conveying control described in FIG. 13.

Figure 16:
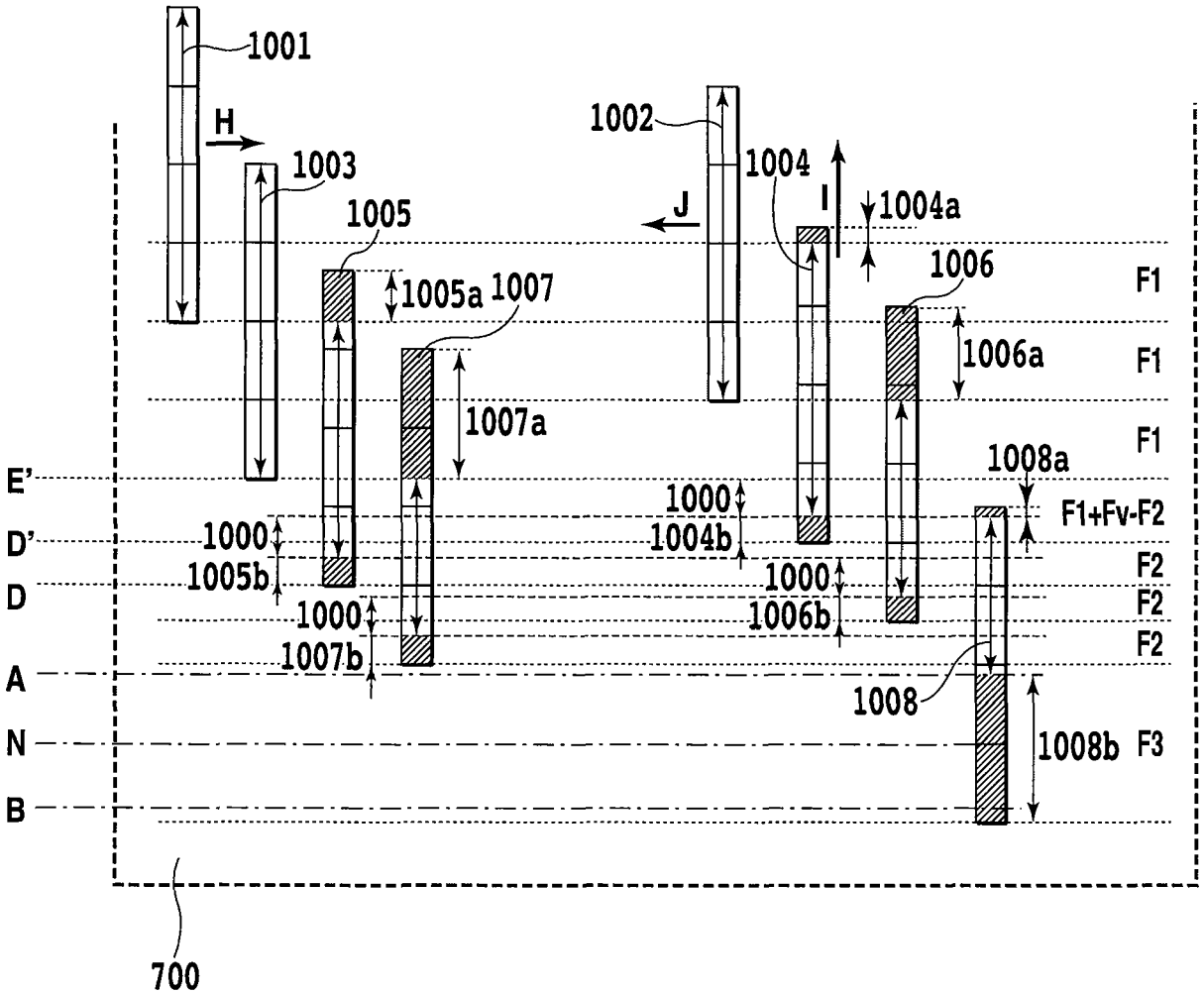
FIG. 16 is a diagram explaining the feature of the conveying control in the second embodiment.

FIG. 16 is a diagram explaining the feature of the conveying control in a case that the conveying amount Fv is smaller than the conveying amount F2. This embodiment differs from the control shown in FIG. 13 in that in a case of the conveying amount Fv smaller than the conveying amount F2, the conveying amount F1 before the conveying amount Fv by one conveying is added to the conveying amount Fv, and then the conveying amount F2 is subtracted from the result of the addition to provide a conveying amount Fv' in place of the conveying mount Fv. More specifically, the conveying amount, which corresponds to 144 nozzles found by "F1+Fv−F2=160+64−80" is provided as new conveying amount Fv'. In addition, the number of times of the conveyance F2 is increased from twice to three times on accompanying providing of new conveying amount Fv'.

Based upon the above conveying control, non-used nozzles 1004*a* to 1008*a*, and 1004*b* to 1008*b* are set at nozzle array positions 1001 to 1008 respectively. The non-used nozzle 1004*a* includes 16 nozzles found by 160(F1)−(160(F1)+64(Fv)−80(F2)), and the non-used nozzle 1005*a* includes 96 nozzles found by 16(1004*a*)+160(F1)−80(F2). In addition, the non-used nozzle 1006*a* includes 176 nozzles found by 96(1005*a*)+160(F1)−80(F2), and the non-used nozzle 1007*a* includes 256 nozzles found by 176(1006*a*)+160(F1)−80(F2). Further, the non-used nozzle 1008*a* includes 16 nozzles found by 256(1007*a*)+80(F2)−320(F3). Further, each of the non-used nozzles 1004*b* to 1007*b* includes 64 nozzles found by 160(F1)+64(Fv)−80(F2)−80 (F2), and the non-used nozzle 1008*b* includes 304 nozzles found by 64(1007*b*)+320(F3)−80(F2).

The mask assigned to the use nozzle by each pass in the above use nozzle range is the same as the mask assigned at the nozzle array position 1500 shown in FIG. 11 in the scans of the nozzle array positions 1001 to 1003. In addition, the above mask is likewise the same as the mask assigned at the nozzle array position 1501 in the scan of the nozzle array position 1004. The above mask is likewise the same as the mask assigned at the nozzle array position 1502 in the scan of the nozzle array position 1005. The above mask is likewise the same as the mask assigned at the nozzle array position 1503 in the scan of the nozzle array position 1006. The above mask is likewise the same as the mask assigned at the nozzle array position 1504 in the scans of the nozzle array positions 1007 and 1008.

Thus, the ROM capacity for storing the mask can be reduced. In addition to it, the print permitting rates of the masks used in each scan can be smoothly controlled, thus reducing the connection stripe due to variations of the conveyance accuracy and preventing image quality deterioration due to the landing position variations of ink from the end nozzle. The present embodiment provides new conveying amount Fv' greater than the conveying amount F2 in the case that the conveying amount Fv is smaller than the conveying amount of the conveyance F2 (Expression (4) is satisfied). Thereby, the conveying control similar to that in the above described case Fv>F2. For setting the variable new conveying amount Fv' to be greater than the amount F2, the conveying amount F2 is previously determined as a value equal to or smaller than half of the conveying amount F1 (Expression (5)). The new conveying amount Fv' obtained as calculation result in which the conveying amounts F1 and Fv are added to each other and the conveying amount F2 is subtracted from the added result (Expression (6)).

$$Fv<F2 \quad \text{Expression (4)}$$

$$F2 \leqq \tfrac{1}{2} \times F1 \quad \text{Expression (5)}$$

$$Fv'=F1+Fv-F2 \quad \text{Expression (6)}$$

As apparent from the above description, setting of non-used nozzles allows the band width determined by the conveying amount of conveyance after the conveyance Fv to be fixed to the amount F2 (band width 80) whatever the conveying amount Fv is determined. Thereby, the applied masks are of two types of masks (a mask corresponding to the conveying amount of 160 nozzles and a mask corresponding to the conveying amount of 80 nozzles). As a result, the ROM capacity for storing the mask can be reduced, the connection stripe due to variations of the conveyance accuracy can be reduced and image quality deterioration due to the landing position variations of ink from the end nozzle can be prevented.

Third Embodiment

Figure 17:
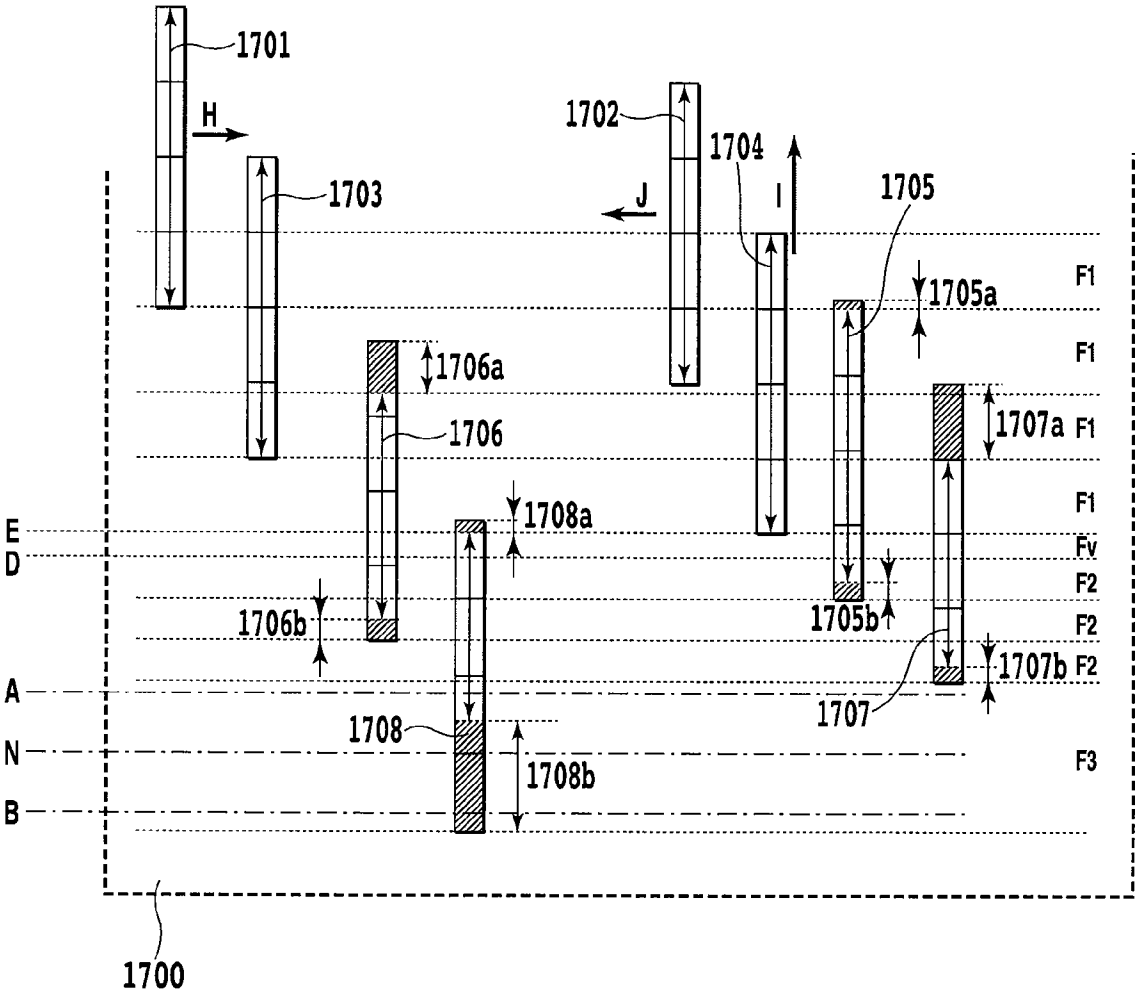
FIG. 17 is a diagram explaining the feature of the conveying control in a third embodiment.

FIG. 17 is a diagram explaining conveying control according to a third embodiment of the present invention. The present embodiment has a feature that in a case where the conveying amount Fv is smaller than the conveying amount F2, the conveying amount (Fv') found by adding the conveying amount F2 provided after the conveying amount Fv by one conveyance to the conveying amount Fv is provided, which is 144 nozzles found by "F2+Fv=80+64". In consequence, in a case where the conveying amount Fv is smaller than the conveying amount F2, the conveyance Fv is absorbed by the conveyance F2 to improve the throughput. In a case where the conveying amount Fv is larger than the conveying amount F2, the control similar to that in FIG. 7 of the first embodiment or in FIG. 12 of the second embodiment is performed. Following expression will be made for a case that the conveying amount Fv corresponds to 64 nozzles.

Based upon the above conveying control, non-used nozzles 1705*a* to 1708*a*, and 1705*b* to 1708*b* are set at nozzle array positions 1701 to 1708 respectively. The non-used nozzle 1705*a* has 16 nozzles found by 160 (F1) minus (64 (Fv) plus 80 (F2)), and the non-used nozzle 1706*a* has 96 nozzles found by 16 (1705*a*) plus 160 (F1) minus 80 (F2). In addition, the non-used nozzle 1707*a* has 176 nozzles found by 96 (1706*a*) plus 160 (F1) minus 80 (F2). In addition, the non-used nozzle 1708*a* has 16 nozzles found by 176 (1707*a*) plus 160 (F1) minus 320 (F3). Further, each of the non-used nozzles 1705*b* to 1707*b* has 64 nozzles of 64 (Fv), and the non-used nozzle 1708*b* has 304 nozzles found by 640 nozzles minus 16 (1708*a*) minus 320 (F2×4). The mask assigned to the use nozzle in each pass in the above use nozzle range is the same as the mask assigned at the nozzle array position 1500 shown in FIG. 11 in the scans of the nozzle array positions 1701 to 1704. In addition, the above mask is likewise the same as the mask assigned at the nozzle array position 1501 in the scan of the nozzle array position 1705. The above mask is likewise the same as the mask assigned at the nozzle array position 1502 in the scan of the nozzle array position 1706. The above mask is likewise the same as the mask assigned at the nozzle array position 1503 in the scan of the nozzle array position 1707. The above mask is likewise the same as the mask assigned at the nozzle array position 1504 in the scans of the nozzle array position 1708.

Thus the kind of the mask in use can be made to two kinds, reducing the ROM capacity for storing the mask. In addition to it, the print permitting rates of the masks used in each scan can be smoothly controlled, thus reducing continuous seams due to variations of the conveyance accuracy and preventing image quality deterioration due to spot variations of the end nozzle.

In the present embodiment, in the same way as the second embodiment, there is explained the construction where plural kinds of masks are provided, each being matched to the band width. However, in a case of further eliminating the ROM capacity, image quality deterioration can be restricted even in the control of cutting and pasting the masks by performing control such a manner as to increase Fv.

The printing operation in the present embodiment is arranged as follows. New conveying amount Fv' which is obtained by adding the conveying amount F2 and the conveying amount Fv is provided in a case that the conveying amount Fv is smaller than the conveying amount of the conveyance F2 (Expression (7) is satisfied). Thereby, the conveyance Fv is absorbed by the conveyance F2 and thus one time of the conveying operation can be omitted to improve the throughput.

$$Fv<F2 \quad \text{Expression (7)}$$

$$Fv'=Fv+F2 \quad \text{Expression (8)}$$

The conveying amount F2 is previously set as a value equal to or smaller than half of the conveying amount F1 (expression (9)). This relation is a condition that the conveying amount Fv' is always equal to or smaller than the conveying amount F1. However, the relation between the conveyance F1 and the conveyance F2 is not always determined to satisfy Expression (9). The conveying control may be defined such that the result of adding the conveying amount F2 and the conveying amount Fv is compared with the conveying amount F1, and then, only when the conveying amount Fv' is equal to or smaller than the conveying amount F1, the conveying amount Fv', which is obtained by adding the conveying amount F2 and the conveying amount Fv, is set.

$$F2 \leqq \tfrac{1}{2} \times F1 \quad \text{Expression (9)}$$

Other Embodiment

Each of the aforementioned embodiments explains the printing operation or the conveying operation for the printing apparatus in the ink jet system, but it is apparent from the above explanation that an application of the present invention is not limited to the printing apparatus in this ink jet system.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-213789, filed Aug. 22, 2008 which is hereby incorporated by reference herein in its entirety.

What is claimed is:

1. A printing apparatus comprising:

a print head including a plurality of printing elements arranged in a predetermined direction, for printing on a predetermined area of a printing medium by scanning in a direction intersecting the predetermined direction;

a conveying roller for conveying the printing medium alternately with the scanning of the print head; and a controller for controlling the conveying roller for performing N (N is equal to or greater than 2) times of a first conveying operation for conveying the printing medium in a first conveying amount with the plurality times of scanning, and M (M is equal to or greater than 2) times of a second conveying operation for conveying the printing medium in a second conveying amount, which is smaller than the first conveying amount, with the plurality of times of scanning, a third conveying operation for conveying the printing medium performed between the first conveying operation and the second conveying operation, and a fourth conveying operation performed next to the second conveying operation for conveying the printing medium in a fourth conveying amount larger than the first conveying amount, the printing medium being released from the roller by the fourth conveying operation, wherein said controller obtains and sets a third conveying amount in the third conveying operation and M, based on a conveying amount at which the printing medium is to be conveyed from a printing medium position of completion of the first conveying operation to a printing medium position of the start of the fourth conveying operation, so that the third conveying amount is smaller than the first conveying amount and equal to or larger than the second conveying amount.

2. A printing apparatus as claimed in claim 1, wherein said controller controls the conveying roller for performing a conveying operation at a number of times that is smaller than any of the N and the M in the third conveying operation.

3. A printing apparatus as claimed in claim 1, wherein said controller controls the conveying roller for performing a conveying operation one time in the third conveying operation.

4. A printing apparatus as claimed in claim 1, wherein said controller sets an arrangement length of printing elements used for printing after the forth conveying operation to be an arrangement length that is smaller than an arrangement length of the first conveying operation by a difference between the fourth conveying amount of the fourth conveying operation and the second conveying amount of the second conveying operation, in a case that the fourth conveying amount is greater than the second conveying amount.

5. A printing apparatus as claimed in claim 1, wherein said controller performs the first and second conveying operations so that the second conveying amount is equal to or smaller than half of the first conveying amount.

6. A printing apparatus as claimed in claim 5, wherein the printing elements ranging from an end printing element at the down stream side of the print head to a printing element at a distance corresponding to the fourth conveying amount of the fourth conveying operation from the end printing element are not used.

7. A printing apparatus as claimed in claim 1, wherein the N is greater than M.

8. A printing apparatus as claimed in claim 1, that performs printing an image to be printed to the predetermined area in the plurality times of scanning by using data which is obtained by using a mask pattern to divide data of the image to be printed to the predetermined area into respective data corresponding to the plurality times of scanning, wherein said printing apparatus uses both a first mask pattern corresponding to the first conveying amount and a second mask pattern corresponding to the second conveying amount in the printing with the scanning which is performed immediately after the third conveying operation.

9. A printing apparatus as claimed in claim 8, wherein the second conveying amount is equal to one-half of the first conveying amount.

10. A printing apparatus as claimed in claim 1, wherein the third conveying amount is larger than the second conveying amount.

11. A printing apparatus as claimed in claim 10, wherein the second conveying amount is equal to one-half of or smaller than the first conveying amount.

12. A printing apparatus as claimed in claim 11, wherein the second conveying amount is equal to one-half of the first conveying amount.

13. A printing method comprising the steps of:

using a conveying roller for conveying a printing medium and performing N (N is equal to or greater than 2) times of a first conveying operation for conveying the printing medium in a first conveying amount with the plurality times of scanning, and M (M is equal to or greater than 2) times of a second conveying operation for conveying the printing medium in a second conveying amount, which is smaller than the first conveying amount, with the plurality of times of scanning, a third conveying operation for conveying the printing medium performed between the first conveying operation and the second conveying operation, and a fourth conveying operation performed next to the second conveying operation for conveying the printing medium in a fourth conveying amount larger than the first conveying amount, the printing medium being released from the roller by the fourth conveying operation, wherein said using step obtains and sets a third conveying amount in the third conveying operation and M, based on a conveying amount at which the printing medium is to be conveyed from a printing medium position of completion of the first conveying operation to a printing medium position of start of the fourth conveying operation, so that the third conveying amount is smaller than the first conveying amount and equal to or larger than the second conveying amount.

14. A printing method as claimed in claim 13, wherein said step performs a conveying operation at a number of times that is smaller than either of N and M in the third conveying operation.

15. A printing method as claimed in claim 7, wherein said step performs a conveying operation one time in the third conveying operation.

16. A printing method as claimed in claim 13, wherein N is greater than M.

17. A printing method as claimed in claim 13, that performs printing an image to be printed to the predetermined area in the plurality times of scanning by using data which is obtained by using a mask pattern to divide data of the image to be printed to the predetermined area into respective data corresponding to the plurality times of scanning, wherein said method uses both a first mask pattern corresponding to the first conveying amount and a second mask pattern corresponding to the second conveying amount in the printing with the scanning which is performed immediately after the third conveying operation.

18. A printing apparatus as claimed in claim 17, wherein the second conveying amount is equal to one-half of the first conveying amount.

19. A printing apparatus as claimed in claim 13, wherein the third conveying amount is larger than the second conveying amount.

20. A printing apparatus as claimed in claim 19, wherein the second conveying amount is equal to one-half of or smaller than the first conveying amount.

21. A printing apparatus as claimed in claim 20, wherein the second conveying amount is equal to one-half of the first conveying amount.

* * * * *